US011503978B2

(12) United States Patent
Cerruti

(10) Patent No.: US 11,503,978 B2
(45) Date of Patent: Nov. 22, 2022

(54) WASHING-AGENT DISPENSER FOR HOUSEHOLD MACHINES FOR WASHING, IN PARTICULAR DISHWASHERS

(71) Applicant: ELTEK S.p.A., Casale Monferrato (IT)

(72) Inventor: Daniele Cerruti, Casale Monferrato (IT)

(73) Assignee: ELTEK S.p.A., Casale Monferrato (IT)

( * ) Notice: Subject to any disclaimer, the term of this patent is extended or adjusted under 35 U.S.C. 154(b) by 474 days.

(21) Appl. No.: 16/612,133

(22) PCT Filed: May 11, 2018

(86) PCT No.: PCT/IB2018/053283
§ 371 (c)(1),
(2) Date: Nov. 8, 2019

(87) PCT Pub. No.: WO2018/207138
PCT Pub. Date: Nov. 15, 2018

(65) Prior Publication Data

US 2021/0076899 A1 Mar. 18, 2021

(30) Foreign Application Priority Data

May 12, 2017 (IT) ..... 102017000051959

(51) Int. Cl.
*A47L 15/44* (2006.01)

(52) U.S. Cl.
CPC ..... *A47L 15/4409* (2013.01)

(58) Field of Classification Search
CPC ... A47L 15/44; A47L 15/4409; A47L 15/4463
See application file for complete search history.

(56) References Cited

U.S. PATENT DOCUMENTS 5,884,821 A 3/1999 Wilhelmstaetter et al.
2009/0288687 A1* 11/2009 Marone ..... A47L 15/4409 134/93

FOREIGN PATENT DOCUMENTS

| | | |
|---|---|---|
| EP | 1 989 988 | 11/2008 |
| EP | 2 506 751 | 10/2012 |
| WO | 2016/091822 | 6/2016 |

OTHER PUBLICATIONS

International Search Report and Written Opinion of the ISA for PCT/IB2018/053283, dated Aug. 23, 2018, 12 pages.

* cited by examiner

*Primary Examiner* — David G Cormier
(74) *Attorney, Agent, or Firm* — Nixon & Vanderhye P.C.

(57) ABSTRACT

A washing-agent dispenser for machines for washing, in particular dishwashers, comprises: a dispenser body (11) with at least one receptacle FIG. 14 (12, 12*a*) for containing a washing agent; at least one hatch (20) having a hatch body (21) mounted in a guided way relative to the dispenser body (11) for being slidable between a position of closing and a position of opening of the at least one receptacle (12, 12*a*), the hatch body (21) having two longitudinal sides (21*b*, 21*c*) generally parallel to one another and with respect to a direction of displacement of the hatch body (21) between the position of opening and the position of closing; and a guide arrangement (25-27, 30*a*-30*b*, 31*a*-31*b*) between the dispenser body (11) and the hatch body (21), for guiding displacement of the hatch body (21) between the position of opening and the position of closing. The guide arrangement (25-27, 30*a*-30*b*, 31*a*-31*b*) comprises at least one movable guide element (25), in a position corresponding to a respective longitudinal side (21*b*, 21*c*) of the hatch body (21), the movable guide element (25) being constrained to the dis- (Continued)

penser body (11) for being slidable between an inoperative position and an operative position.

20 Claims, 16 Drawing Sheets

Fig. 31
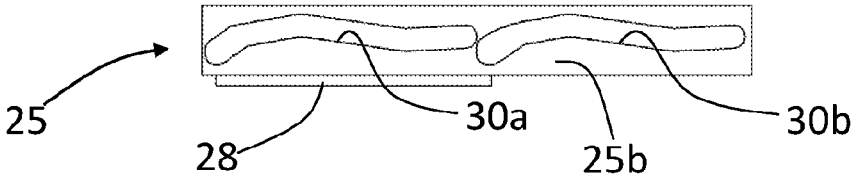
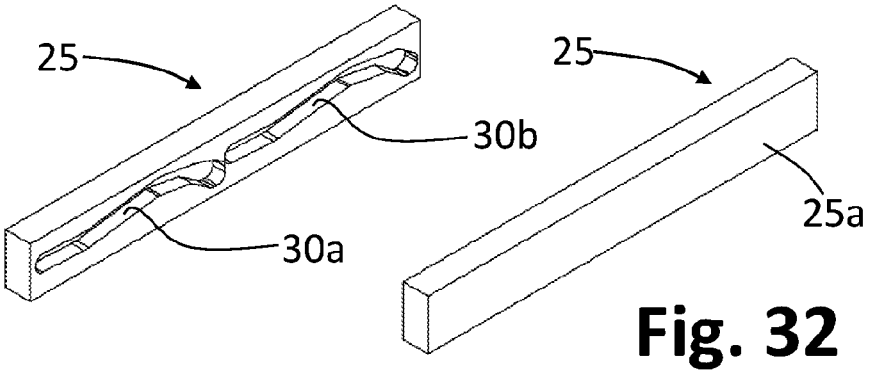
Fig. 32
Fig. 33
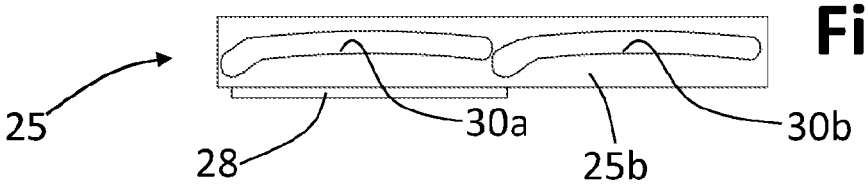
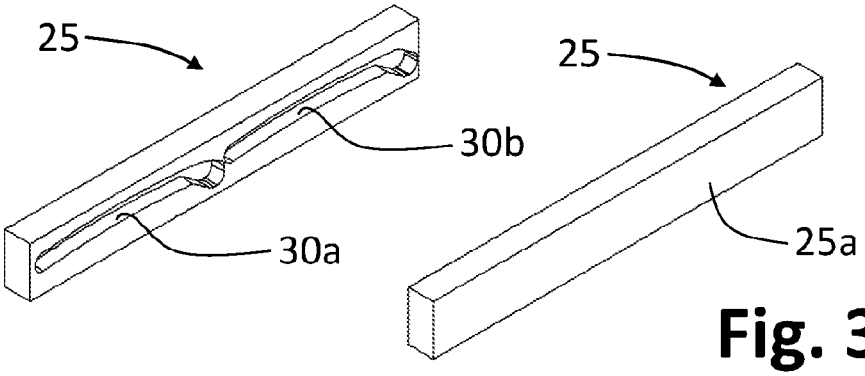
Fig. 34

WASHING-AGENT DISPENSER FOR HOUSEHOLD MACHINES FOR WASHING, IN PARTICULAR DISHWASHERS

This application is the U.S. national phase of International Application No. PCT/IB2018/053283 filed 11 May 2018, which designated the U.S. and claims priority to IT Patent Application No. 102017000051959 filed 12 May 2017, the entire contents of each of which are hereby incorporated by reference.

DESCRIPTION

Field of the Invention

The present invention relates to dispensers of washing agents for household machines for washing, in particular dishwashers, and has been developed with particular reference to dispensers equipped with at least one slidable hatch.

Prior Art

Some household machines for washing, and in particular dishwashers, are equipped with a device for dispensing washing products that is configured for dispensing at least one washing agent. Generally, such devices are provided for dispensing, at different moments of one and the same washing cycle of the dishwasher, two different washing agents, typically represented by a detergent in solid form (powder or tablets) and by a liquid rinsing additive. Also known are dispensers provided for delivery of just one washing substance in solid or else liquid form.

In the most widespread solutions, dispensers for dishwashers comprise a main body obtained by moulding of thermoplastic material, which is associated to one of the vertical walls that delimit the washing tub of the machine (including the inner shell of the front door of the machine that faces the inside of the washing tub) and is usually at least partially recessed in a fluid-tight way in an opening provided in the aforesaid wall. Defined in the front area of the body of the dispenser in a receptacle for containing a washing agent, usually a washing powder or a detergent in the tablet form, necessary for carrying out a washing cycle. The receptacle is equipped with a closing hatch, which also has a respective body of plastic material. Operative between the body of the dispenser and the body of the hatch are elastic means, which urge the hatch towards a respective opening position, as well as a system for blocking/release of the hatch. In the course of a washing cycle, opening of the aforesaid hatch is controlled appropriately by a programmer, or timer, of the machine, which controls an actuator forming part of the aforesaid blocking/release system; the latter is usually conceived also to enable, with the machine not in operation, manual opening and closing of the hatch.

In some known solutions, the body of the hatch is constrained to the body of the dispenser in a slidable way so that it can slide between a closing position and an opening position in a substantially linear way or else following a path that is at least in part inclined or curved. For this purpose, a corresponding guide arrangement is provided between the body of the dispenser and the body of the hatch. Devices of this type are known, for example, from U.S. Pat. No. 5,884,821 A and DE102005004098 A.

A known solution, substantially of the type described in DE102005004098 A, is exemplified schematically in FIGS. 1 to 6, where the dispenser is designated as a whole by 1 and where the bodies of the hatch and of the dispenser are designated by 2 and 3, respectively. The body 2 of the hatch has two opposite lateral portions or faces, constituted by walls 2*a* and 2*b* generally parallel to one another and with respect to the direction of sliding of the hatch, indicated schematically by the arrow D of FIG. 1 (in the cited prior document the movement of the hatch occurs according to a generally arched path).

The body 3 of the dispenser has two corresponding opposite lateral portions or walls 3*a* and 3*b*, generally parallel to one another and with respect to the aforesaid walls 2*a* and 2*b* of the body 2 of the hatch, where the outer side of each of the walls 2*a* and 2*b* faces the inner side of a corresponding wall 3*a* and 3*b*. At the outer side of each of the walls 2*a* and 2*b* two projecting elements or studs 4 are provided, set at a distance from one another in the sliding direction D, also referred to hereinafter as "pins" for simplicity. A first pin 4 is located on the respective side wall 2*a* or 2*b* in the proximity of one end thereof, i.e., in the proximity of a transverse wall 2*c* of the hatch 2, while the other pin 4 is located in an intermediate area of the respective side wall 2*a* or 2*b*. Each pin 4 is slidably engaged in a respective guiding recess 5 defined on the inner side of the corresponding wall 3*a* or 3*b*, where the two guiding recesses 5 of each wall 3*a* or 3*b* are arranged substantially one after another in the sliding direction D.

In FIG. 2, moreover, designated by 6 is a receptacle for containing an amount of washing agent, for example a detergent in powder or tablet form, the mouth of which is delimited by a projecting annular lip 6*a*, on which there is designed to operate in a fluid-tight way a gasket, designated by 7 in FIGS. 3-4, associated to the body of the hatch 2. Designated by 8 is a spring operative for urging the body of the hatch 2 towards an opening position. The dispenser 1 further comprises a system (not shown) for blocking/release of the hatch 2.

The dispensers according to the prior art described in general present a relatively limited opening travel of the hatch 2 from the closing position to the opening position, with the anomalous consequence that—even in the opening position—the receptacle 6 is not completely exposed. A reduced opening of the hatch might not guarantee delivery of washing agents in the form of tablets, or ones having a wrapper. Moreover, the aforesaid limited opening of the hatch determines a reduced exposure of the receptacle to the washing jets, consequently limiting removal of a washing agent in powder form and cleaning-out of the receptacle via said washing jets. In the case of incomplete removal of a powdered washing agent, the corresponding residue tends to adhere to the receptacle and to the hatch, subsequently solidifying with risks of blocking the mechanism for opening/closing the hatch itself.

To clarify these aspects more fully, in FIGS. 3 and 5 the known dispenser 1 is represented in the condition of closing of the corresponding hatch 2, whereas in FIGS. 4 and 6 the dispenser is represented in the condition of maximum opening of the hatch 2. It should be noted that in these schematic figures representation of some elements has been omitted, such as the spring 8 and, in FIGS. 5-6, the gasket 7 and the projecting lip 6*a* of the receptacle 6. In FIG. 5, as in FIG. 6, the dashed line T exemplifies the inner side of the door of the dishwasher, provided with an opening in which the body 3 of the dispenser 1 is partially set in.

When the hatch 2 is released by the corresponding blocking/release system, it is urged by the corresponding spring towards the opening position, i.e., with a sliding of the guided elements, represented by the pins 4, along the corresponding guiding elements, represented by the recesses 5. In the course of this movement, the pins 4 traverse the inclined stretches of the recesses 5, thereby determining a slight raising of the hatch 2. The hatch 2 then proceeds with the opening movement, until mechanical interference occurs between the pins 4 and the second ends of the recesses 5, as represented schematically in FIGS. 4 and 6. As may be seen in these figures, the known arrangement illustrated enables a relatively limited travel of the hatch 2 from the closing position to the opening position to be obtained, with the consequence that—even in the opening position—the receptacle 6 is only partially open or exposed: as has been said, this may complicate delivery of a detergent and/or its complete removal from the receptacle 6, in particular hindering delivery or falling into the tub of washing agents in powder or tablet form or a washing-agent pack (such as packs of the type defined as "3-in-1" and "4-in-1") contained in the receptacle 6. Also loading of the washing agent is in some way hindered by the fact that part of the hatch 2 overlies the receptacle 12.

Apparently, the above drawback could be obviated by reducing the dimensions of the receptacle. However, this limits the containment capacity of the receptacle, not enabling filling thereof with the correct dose or housing of some of the aforesaid of washing-agent packs, such as tablets that commercially present different shapes. A displacement of the receptacle in order to define it completely in the area of the body 3 of the dispenser that is exposed following upon opening of the hatch 2 would not be possible for problems of space (from FIGS. 5 and 6 it is evident how close the receptacle already is to the outer part of the lower portion of the body 3 that is to be set into the door of the washing machine), and in any case would considerably complicate production of the dispenser 1.

In some known dispenser devices with slidable hatch, not necessarily of the type described in DE102005004098 A, a portion of the hatch projects substantially in cantilever fashion from the main body of the dispenser, when it is in the open position. This can give rise to a low stability or solidity of the hatch 2. Also this problem can be appreciated with reference by way of example to FIG. 6, where an open portion of the hatch 2 projects from the body 3 of the dispenser. In this condition, it may occur that a thrust is accidentally exerted on this projecting portion, substantially as indicated by the arrow P: consider, for example, that the user happens to rest involuntarily or exert an anomalous thrust on the hatch during closing thereof.

OBJECT AND SUMMARY OF THE INVENTION

The aim of the present invention is basically to solve one or more of the aforesaid drawbacks of the prior art.

According to a first aspect, an aim of the present invention is to provide a washing-agent dispenser that enables an increased travel of opening of a corresponding slidable hatch to be obtained, in particular towards the outside of the profile delimited by the body of the dispenser.

According to another aspect, an aim of the present invention is to provide a washing-agent dispenser distinguished by a good stability of movement of a corresponding slidable hatch, even in the case where the corresponding dispenser body is of relatively small size, in particular in the case of a washing-agent dispenser with an opening of the slidable hatch towards the outside of the profile delimited by the body of the dispenser.

According to a further aspect, an aim of the present invention is to provide a washing-agent dispenser that enables an increased stability or protection of a corresponding slidable hatch to be obtained, when the hatch itself is in the opening position or moves towards this position.

One or more of the above aims are achieved, according to the present invention, by a washing-agent dispenser that presents, among other things, the characteristics specified also in the claims. The aims of the invention are likewise achieved by a machine for washing, in particular a dishwasher, including such a dispenser.

BRIEF DESCRIPTION OF THE DRAWINGS

Further objects, characteristics, and advantages of the present invention will emerge clearly from the ensuing detailed description, with reference to the annexed schematic drawings, which are provided purely by way of non-limiting example and in which:

FIG. 31 is a schematic view in side elevation of a further guide component that can be used in a washing-agent dispenser according to further possible embodiments of the invention;

FIG. 32 is a schematic perspective view of two components of the type illustrated in FIG. 31; and FIGS. 33 and 34 are views similar to those of FIGS. 31-32, corresponding to a further guide component that can be used in a washing-agent dispenser according to further possible embodiments of the invention.

DESCRIPTION OF PREFERRED EMBODIMENTS OF THE INVENTION

The reference to "an embodiment" or "one embodiment" in the framework of the present description is intended to indicate that a particular configuration, structure, or characteristic described in relation to the embodiment is comprised in at least one embodiment. Hence, phrases such as "in an embodiment", "in various embodiments", and the like that may be present in various points of this description do not necessarily refer to one and the same embodiment. In the context of this description, where not otherwise specified or when not immediately evident from the context described, definitions of position such as "top", "bottom", "side", "initial", "final", and the like is are understood as referring to the arrangement illustrated in a given figure and are in any case non-limiting. Moreover, particular configurations and/or structures and/or characteristics described may be considered individually or combined in any adequate way, in one or more embodiments, even different from the embodiments of described by way of non-limiting example hereinafter. The reference numbers and spatial references (such as "top", "bottom", "upper", "lower", "front", "back", "vertical", etc.) used herein, in particular with reference to the examples in the figures, are only provided for convenience and hence do not define the sphere of protection or the scope of the embodiments. In the figures the same reference numbers are used to designate elements that are similar or technically equivalent to one another.

It is moreover pointed out that, in the present description and in the attached claims, terms such as "inner" or "internal", when referred to a side, a face, or a surface of a portion, wall, or element of a dispenser body and of a hatch body, are understood as designating a side, a face, or a surface of said portion, wall, or element that substantially faces an intermediate area of the dispenser, in particular where a receptacle for containing a washing agent opens, it being possible for this area preferably to be at least partially subtended by the body of a hatch. Terms such as "outer" or "external", when also these refer to a side, a face, or a surface of a portion, wall, or element of a dispenser body and of a hatch body, are consequently intended to designate a side, a face, or a surface of said portion, wall, or element that face in a direction generally opposite to the direction identified by the terms "inner" or "internal" referring to the same portion, wall, or element.

Figure 7:
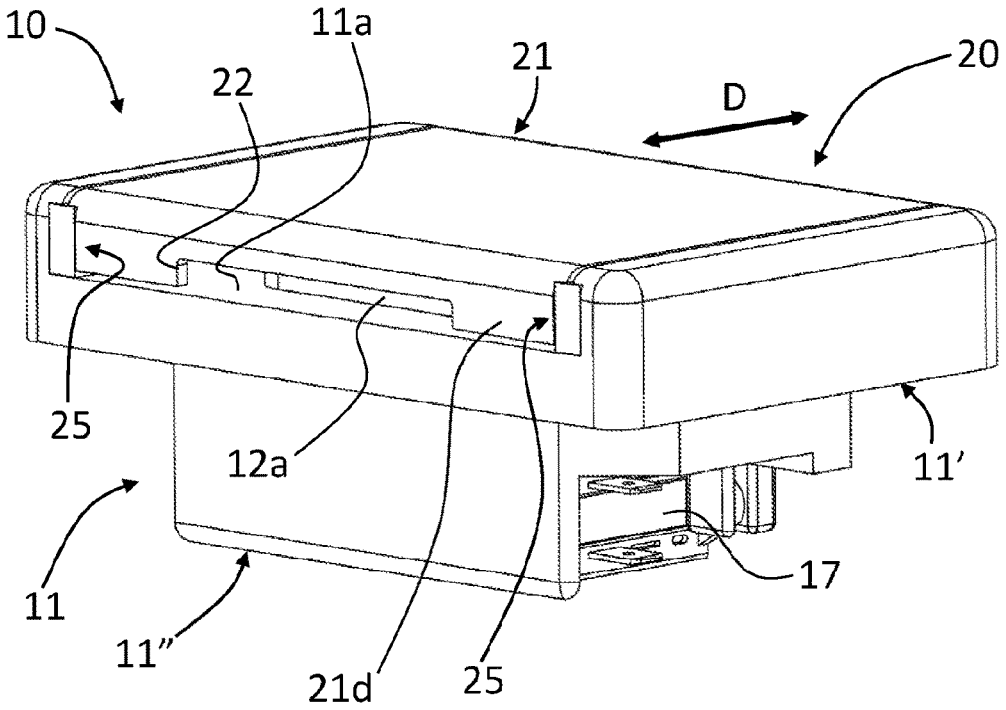
FIGS. 7 and 8 are schematic perspective views, from different angles, of a washing-agent dispenser according to possible embodiments of the invention.
Figure 8:
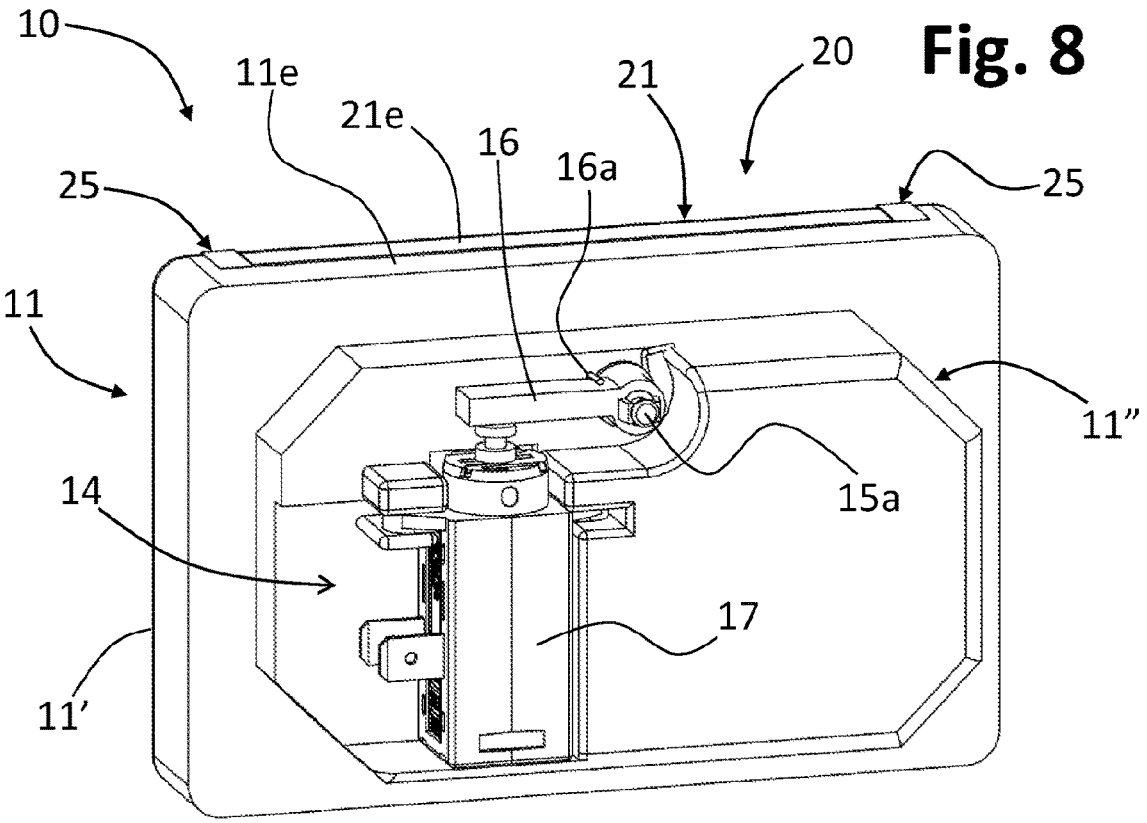
Figure 9:
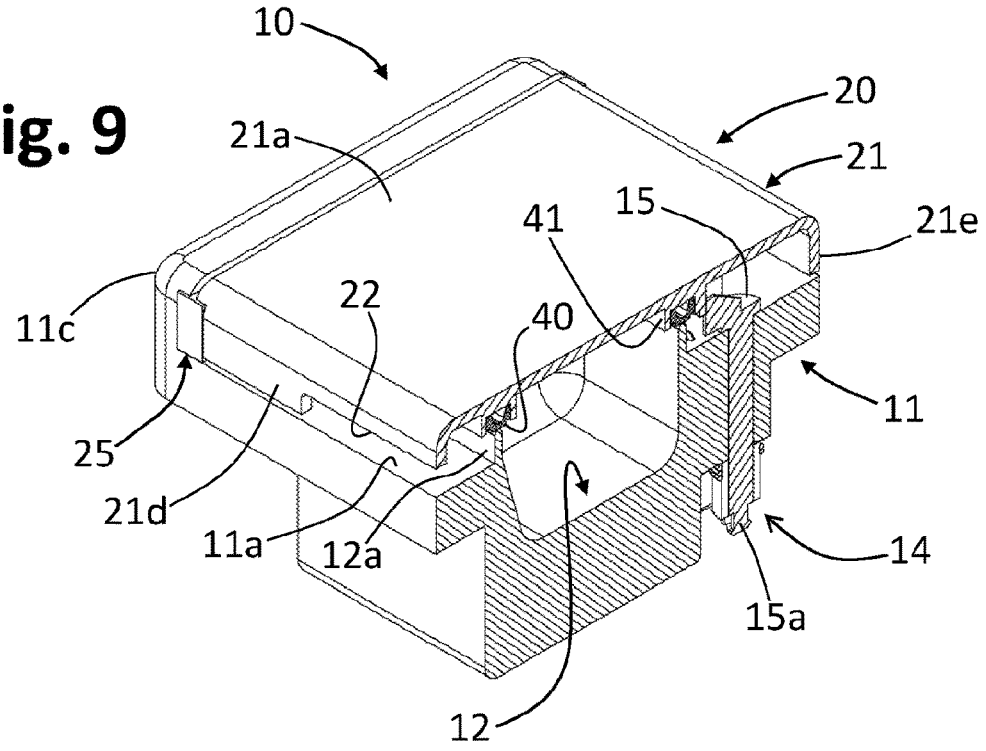
FIG. 9 is a sectioned perspective view of the dispenser of FIGS. 7-8.

With initial reference to FIGS. 7-9, designated as a whole by 10 is a device for dispensing washing agents according to possible embodiments of the present invention. In what follows, it is assumed that the dispenser 10 is fixed to a wall that delimits the washing tub of a dishwasher, in particular a wall defined by the door of the machine. It should, however, be considered that the dispenser according to the invention could also be fixed to some other part of the washing machine, preferably within a treatment tub, such as a dispenser fixed to a dish rack, or else be a dispenser configured as component separate from the machine, but designed to be set by the user in the corresponding treatment tub.

The dispenser comprises a dispenser body 11, which is made at least in part of moulded plastic material, in particular a thermoplastic material. In the example illustrated, the dispenser body 11 comprises a front piece or part 11', designed to face or be located in a washing tub, and a rear piece or part 11", preferably designed to be at least in part inserted in an opening of a wall of the tub, or fixed in some other way to a wall or some other part of the machine, such as a dish rack. For example, in FIG. 11 the dashed line T exemplifies the inner side of the door of a dishwasher, which is provided with an opening in which the body 3 of the dispenser 1 is partially set in (it could, however, exemplify a wall of a dish rack). The parts 11' and 11" are conveniently moulded with thermoplastic material separately from one another and then joined together, for example, via welding. The dispenser 10 may in any case have parts 11', 11" differently constructed and shaped. In the sequel of the present description, generic reference will be made to the dispenser body 11, taking for granted that the characteristics that pertain to the present invention basically refer to its front part 11', which defines an upper face of the dispenser, associated to which is at least one slidable hatch.

Figure 10:
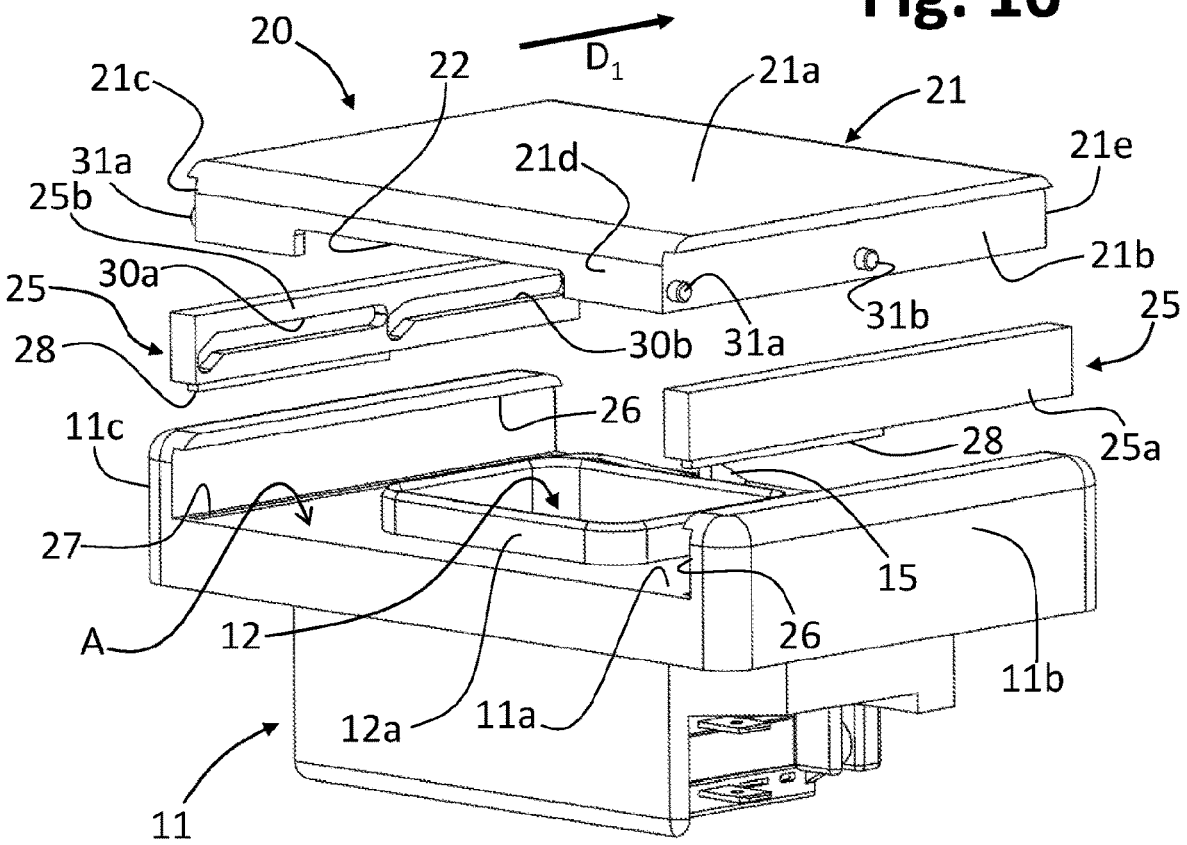
FIGS. 10 and 11 are partially exploded views, from different angles, of the dispenser of FIGS. 7-8.
Figure 11:
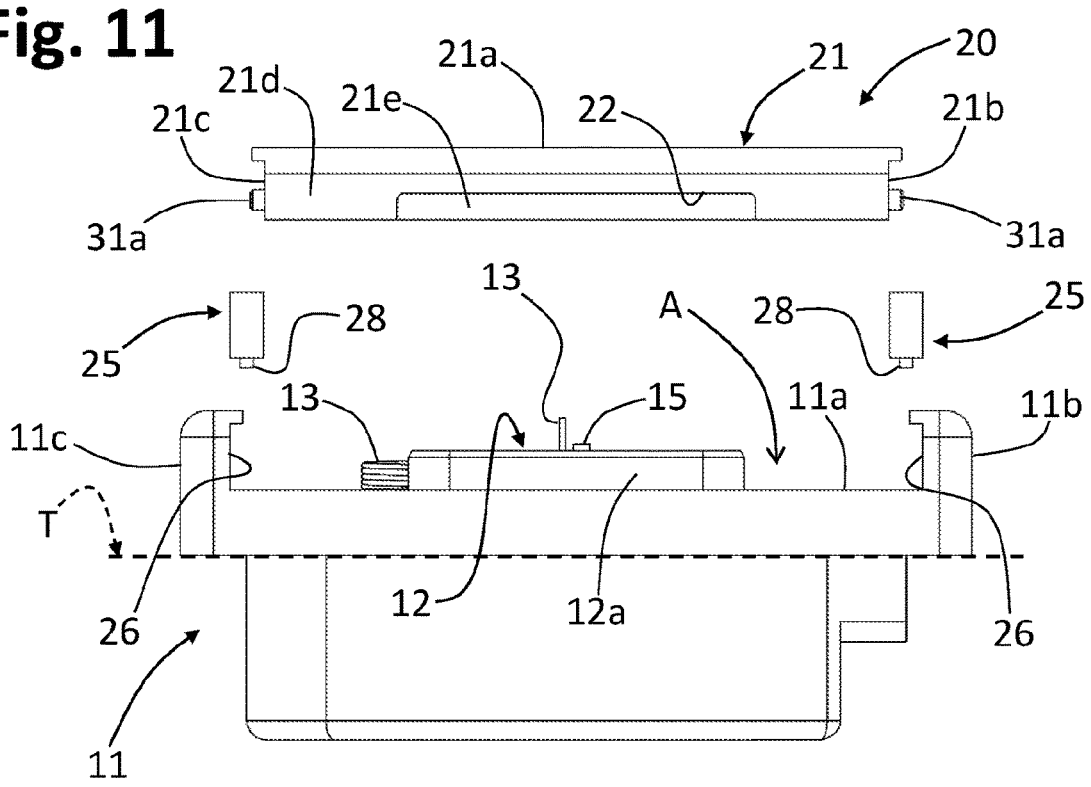

With reference also to FIGS. 10-11, in an area A of the body of the dispenser 10, here including a wall 11*a* of the upper face of the body itself, preferably but not necessarily a substantially plane or slightly curved wall, a receptacle 12 is defined that is designed to contain a washing agent, such as a solid washing agent in powder or tablet form (washing substances in some other form, such as a liquid or a gel, not being, however, excluded).

Figure 16:
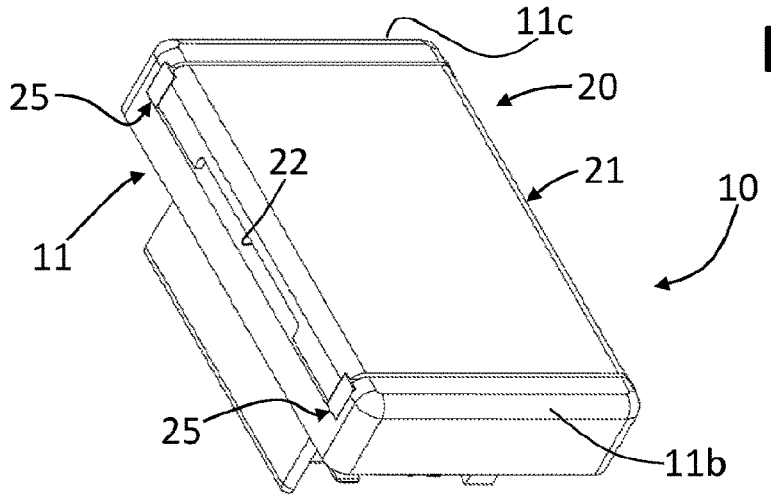
FIGS. 16, 17, and 18 are schematic perspective views of the washing-agent dispenser of FIGS. 7-8, in conditions of hatch closed, hatch half-open, and hatch open, respectively.
Figure 18:
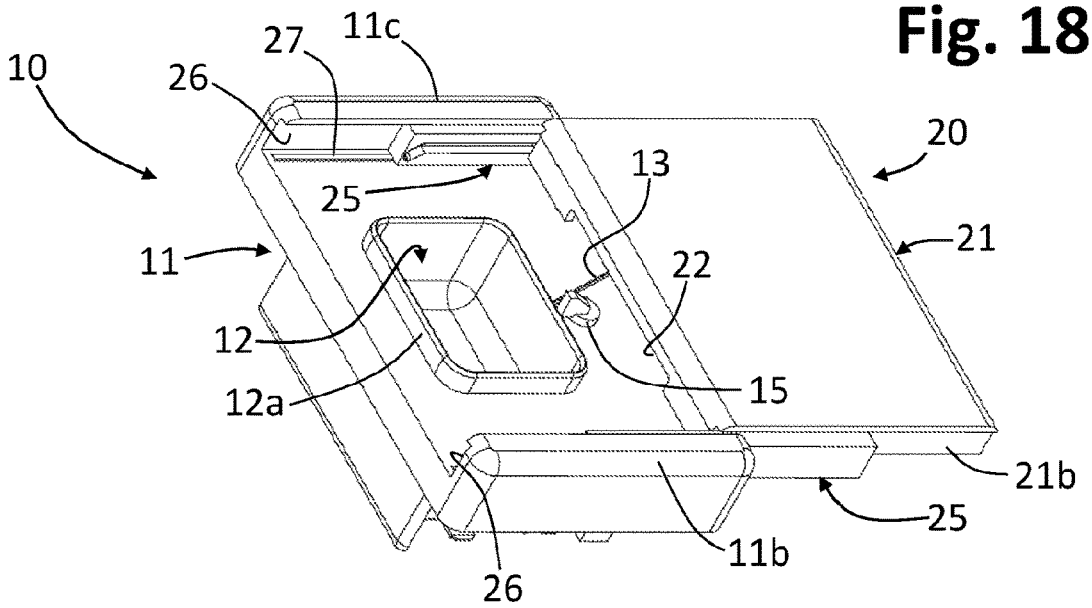
Figure 19:
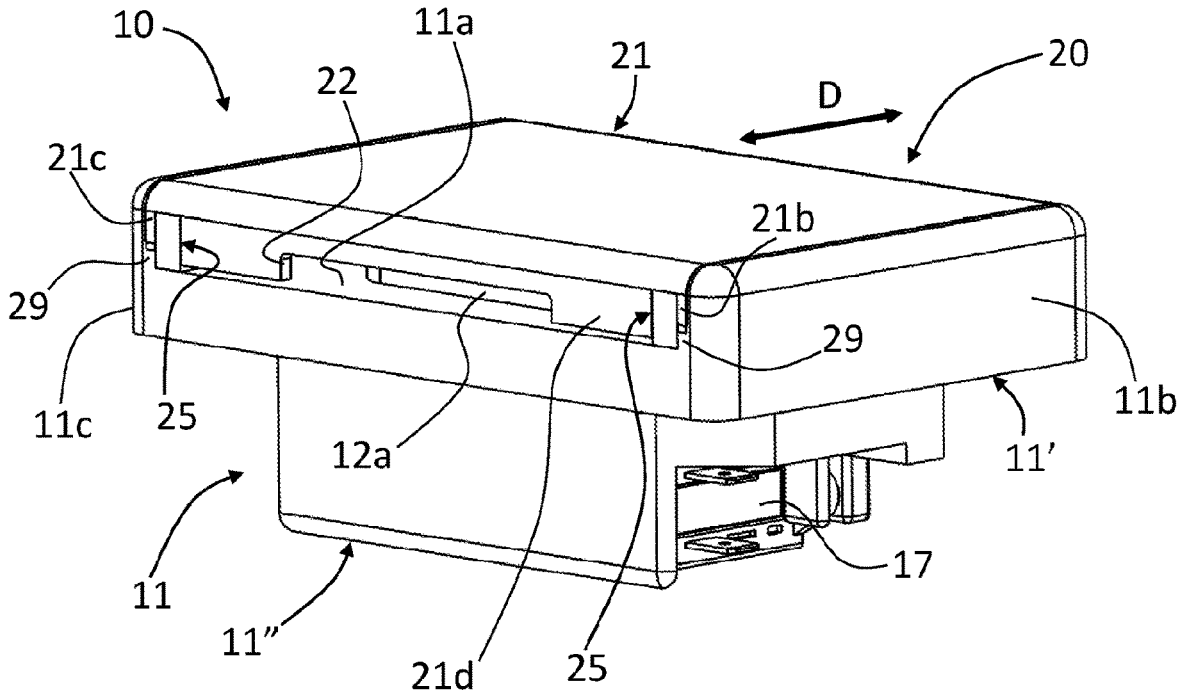
FIG. 19 is a schematic perspective view of a washing-agent dispenser according to further possible embodiments of the invention.

The mouth of the receptacle 12 is preferably surrounded by a projecting edge or lip 12*a*, which here rises from the wall 11*a*. In, or in the proximity of, the area A, associated to the body 11 is a hatch, designated as a whole by 20 and comprising a hatch body 21, preferentially obtained via moulding of thermoplastic material, which may be similar to the material constituting the dispenser body 11, for example a polypropylene filled with reinforcement material, such as talc or glass fibre. The hatch 20 is slidable in a guided way on the body 11 so as to be displaceable between a position of closing and a position of opening of the receptacle 12, as illustrated in FIGS. 16 and 18, respectively. For this purpose, the hatch body 21 is constrained or associated so as to be movable relative to the dispenser body 11 via a guide arrangement, described hereinafter.

In the example of embodiment illustrated, the dispenser 10 is devised for delivery of the washing agent contained in the receptacle 12 only, but in other embodiments (not represented) the dispenser could include a further arrangement for dosing and/or delivering at least one further washing agent, for example, a liquid rinse-aid. For instance, with reference to FIGS. 7-8, the body of the dispenser may have lateral dimensions larger than what is represented and present, in a lateral area not covered by the hatch 20, the mouth of a tank of a second washing agent, such as a liquid agent, for example a rinse-aid agent, with a corresponding outlet opening forming part of a corresponding delivery system.

In various embodiments, the hatch body 21 is urged towards the respective condition of opening of the receptacle 12 via elastic means, comprising, for example, a spring. One such spring is, for instance, designated by 13 in FIG. 11, the ends of which are constrained between the dispenser body 11 and the hatch body 21 (see for reference also FIGS. 14, 15, and 18), possibly also via other interposed elements, for example, constrained via a coupling or engagement mechanism, or via deformation of the thermoplastic material that forms the body.

Operatively set between the body 11 and the body 21 is a system for blocking/release of the hatch 20, for example, of the type designated as a whole by 14 in FIGS. 8-9, which can be controlled by a programmer of the machine or else in a manual way. As visible in FIGS. 8-9, such a system 14 may include, for example, an engagement mechanism 15 in the area A, fixed to, or integral with, the first end of a shaft 15*a* passing through the body 11. Fixed or associated to the second end of the shaft 15*a*, at the back of the body 11, is a lever 16 (FIG. 8), subject to the reaction of a corresponding spring 16*a*. The lever 16 can be displaced by an electric actuator 17, for example a thermoelectric or solenoid actuator so as to cause a rotation of the shaft 15*a* and, hence, of the engagement mechanism 15, which releases a corresponding catch (not represented) provided on an inner side of the hatch 20.

In various embodiments, as, for example, may be seen in FIGS. 10-11, the area A—in which the receptacle 12 is defined and in which the hatch 20 moves—is delimited laterally by portions of the body 11 that rise from a general plane, here substantially identified by the wall 11*a*. More in general, this area A is laterally delimited by two portions or walls generally opposite or set at a distance apart, designated by 11*b* and 11*c*, which are preferably substantially parallel to one another and/or with respect to the direction of sliding or displacement of the hatch, indicated by the arrow D in FIG. 7.

The opposite portions 11*b* and 11*c*—here referred to as "walls"—may comprise, for example, at least two portions of the body 11 that are in relief with respect to the plane of the area A or to the inlet plane of the receptacle 12, preferentially located substantially in the proximity of the two opposite sides of the hatch 20 (the walls 11*b* and 11*c* could also be underneath the hatch 20). In the embodiment illustrated, the walls 11*b* and 11*c* are walls in relief, substantially at the lateral ends of the body 11. These walls 11*b* and 11*c* are preferably integrated in the body 11, it being possible, however, for them to be associated in some other way, such as by welding or gluing or via some sort of catch. In other embodiments, at least one of the walls 11*b* and 11*c*, or an additional wall, may be an intermediate wall in relief, for example a wall of separation between the area A and the area in which the aforementioned mouth of a tank for a second liquid washing agent is located and/or may be a wall located at least in part underneath the hatch body 21.

The hatch body 21 has a main wall 21*a*, the inner side of which generally faces the wall 11*a* of the body 11, as well as a series of side walls, which in the example branch off from the wall 21*a* towards the wall 11*a*. More in general, the hatch body 21 has at least two sides or side walls, designated by 21*b* and 21*c*, which are preferably generally parallel to one another and/or to the direction of sliding D of the hatch 20, and are hence preferably substantially parallel to the walls 11*b* and 11*c* of the body 11. These walls 21*b* and 21*c* are preferably integrated in the hatch body 21, it being possible, however, for them to be associated in some other way, such as by welding or gluing or via some sort of catch.

From FIG. 9 it should be noted how, mounted in a region of the lower face of the hatch body 21 (corresponding to the inner side of its wall 21*a*) that is comprised between the walls 21*b* and 21*c* is an annular gasket 40, preferably having a substantially quadrangular development or, more in general, a development similar to that of the projecting edge or lip 12*a* of the receptacle 12. The gasket 40 is preferentially mounted in a respective housing or seat 41 defined on the inner side of the wall 21*a*. The gasket 40 could in any case be absent, or have a shape different from the one exemplified.

Visible in FIGS. 10-15 are various portions of the body 11 and of the body 21 of specific interest for the purposes of possible embodiments of the invention, comprising the walls 11*b* and 11*c* of the dispenser body 11 and the walls 21*b* and 21*c* of the hatch body 21.

As already mentioned, the dispenser 10 has a guide arrangement between the dispenser body 11 and the hatch body 21, provided for constraining and guiding displacement of the hatch body 21 between its opening and closing positions.

According to the invention, the above guide arrangement comprises at least one movable guide element, in a position corresponding to a respective longitudinal side or wall of the hatch body 21, the longitudinal side or wall being here identified by the walls 21*b* or 21*c*. In preferred embodiments, the guide arrangement comprises two of the above movable guide elements, each in a position corresponding to a respective longitudinal side or wall of the hatch body 21, the longitudinal sides or walls being here identified by the walls 21*b* or 21*c*. In possible embodiments, two movable guide elements of the type referred to are fixed with respect to one another or defined in a single body, or by one and the same movable guide member.

As will emerge clearly hereinafter, the movable guide elements, designated by 25, are constrained to the dispenser body 11 for being slidable between an inoperative position (visible, for example, in FIGS. 12 and 16) and an operative position (visible, for example, in FIGS. 14, 15, and 18), with the hatch body 21 that is in turn constrained to the movable guide elements 25 for being slidable between a respective inoperative position (visible, for example, in FIGS. 12, 13, 16, and 17) and a respective operative position (visible, for example, in FIGS. 14, 15, and 18), the latter corresponding to the position of complete opening of the hatch 20.

The movable guide elements 25, which are preferentially made of a mouldable plastic material, in particular a thermoplastic material that may be similar to the material constituting the dispenser body 11 and/or the hatch body 21, have a generally elongated, in particular substantially parallelepipedal, shape. Clearly visible in FIG. 10 are the outer side or face 25*a* of one element 25 and the inner side or face 25*b* of the other element 25. It should be noted that, in the case exemplified, the elements 25 have a substantially specular shape. As mentioned, the movable guide elements 25 could belong to one and the same movable guide member, for example, being joined or connected together by means of an end cross member.

In various embodiments, the guide arrangement comprises guiding members, which belong to the elements 25, and guided members that belong to the hatch body 21, with the guided members that are slidably coupled to the guiding members.

In preferential embodiments, the movable guide elements 25 are each operatively set between the walls 11*b* and 21*b* and the walls 11*c* and 21*c*, respectively, with the aforesaid guiding members and guided members that are located at the mutually facing sides of the elements 25 and of the walls 21*b* and 21*c*, respectively.

In various embodiments, such as the one represented, the aforesaid facing sides are the outer sides or faces of the walls 21*b* and 21*c* and the inner sides or faces 25*b* of the elements 25, but this does not constitute an essential characteristic of the invention. In fact, according to alternative embodiments, the aforesaid facing sides could be the inner sides or faces of the walls 21*b* and 21*c* and the outer sides or faces 25*a* of the elements 25. On the other hand, according to further embodiments, some of the guiding members and of the corresponding guided members could be provided between the inner side or face of the wall 21*b* and the outer side or face 25*a* of one element 25, whereas the opposite guiding and guided members could be provided between the outer side or face of the wall 21*c* and the inner side or face 25*b* of the other element 25 (or vice versa).

According to various embodiments, and as visible, for example, in FIG. 10, the guiding members comprise at least one seat 30*a*, 30*b* on a first longitudinal face (here the inner face 25*b*) of each movable guide element 25, whereas the guided members comprise at least one projecting element 31*a*, 31*b* on a first longitudinal face (here corresponding to the outer face of the walls 21*b* and 21*c*) of the dispenser body 21 that faces the aforesaid first longitudinal face of the corresponding movable guide element 25, where the at least one projecting element is engaged in the at least one seat.

Preferentially, as in the case exemplified, each element 25 comprises two seats 30*a* and 30*b*, arranged at least in part one after the other along the longitudinal face of the element itself, whereas the corresponding face of the hatch body 21 comprises two projecting elements 31*a* and 31*b*, set at a distance from one another in the direction of sliding of the hatch 20.

In preferred embodiments, the seats 30*a* and 30*b* extend longitudinally, in particular in the form of recesses or similar recessed elements, but not excluded from the scope of the invention is the case of seats defined by parts in relief relative to the side or face of interest of the corresponding guide element 25, for example, in the form of rails. In various embodiments, the projecting elements 31*a*, 31*b* are configured substantially as studs or pins projecting from the corresponding longitudinal wall or face of the hatch body 21, preferably cylindrical pins or, more in general, pins designed to enable prevalently sliding.

In what follows, for simplicity, the guided members 31*a* and 31*b* will also be defined as "guided pins", whereas the guiding members exemplified by the guides 30*a* and 30*b* will also be defined as "guiding recesses", where the term "recesses" is not in any case such as to limit the invention to the case of recessed seats, as already mentioned above.

In various embodiments, the guiding recesses 30*a* and 30*b* on each guide element 25 have the same development in length, but this does not constitute an essential characteristic.

Irrespective of their specific shapes, each of the guiding recesses 30*a*, 30*b* of the elements 25 has preferentially an initial end region and a final end region, which can be engaged by the corresponding guided pins 31*a*, 31*b* when the hatch 20 is in the closing position (as, for example, in FIG. 12) and opening position (as, for example, in FIG. 14), respectively. The terms "initial" and "final" here refer to the direction of movement $D_1$ of the hatch 20 from the closing position to the opening position.

The guiding members or recesses 30*a* and 30*b* are preferably configured in such a way that the gasket 40 will come into in contact with the sealing lip 12*a* of the receptacle 12 only in a conclusive step of displacement of the hatch 20 from the opening position to the closing position, which is usually carried out manually by a user after loading of a washing agent into the receptacle itself. For this purpose, preferably, in various embodiments, an initial end region of each guiding recess 30*a*, 30*b* has a recess portion that extends downwards, i.e., towards the main wall 11*a* of the dispenser body 11, with respect to a remaining main portion of the recess itself, herein a main portion that is substantially linear or rectilinear. It will be appreciated that, with this arrangement, in the aforesaid final step of sliding of the hatch 20 into the closing position, a displacement downwards of the hatch itself is brought about, so that in its condition of engagement the sealing surface of the gasket 40 is pressed on the sealing edge 12*a* of the receptacle 12.

The figures so far described illustrate the case of guiding members or recesses 30*a*, 30*b* that are prevalently rectilinear and have an initial end portion that is inclined, but these members or recesses may have also portions of a different shape, as exemplified hereinafter with reference to the embodiments of FIGS. 31-32 and 33-34.

From the figures, and in particular from FIG. 10, it may be noted how, in preferred embodiments, the proximal or initial ends of the guiding recesses 30*a* are each located in an end region of the corresponding side or face (here the inner side 25*b*) of the movable guide element 25, with the corresponding guided pins 31*a* that are each located in an end region of the corresponding side or face of the wall 21*b* or 21*c* of the hatch body 21. The proximal or initial ends of the guiding recesses 30*b* are each located, instead, in an intermediate region of the corresponding side or face (here the inner side 25*b*) of the movable guide element 25, with the corresponding guided pins 31*b* that are each located in an intermediate region of the corresponding side or face of the wall 21*b* or 21*c* of the hatch body 21.

In various embodiments, the guide arrangement of the hatch comprises at least one sliding seat for each movable guide element 25, which is defined in the dispenser body 11. In various preferred embodiments of this type, the at least one sliding seat is substantially defined in a respective wall 11*b*, 11*c* of the dispenser body 11.

With reference to the case exemplified, as has been seen, the dispenser body 11 has two opposite walls 1*b* and 11*c*, which are generally parallel to one another and with respect to the direction of displacement D of the hatch body 21 between the opening and closing positions. In the specific case exemplified, at least two distinct sliding seats are provided for each element 25, substantially in a respective wall 11*b* or 11*c*, namely:

at least one first sliding seat, designated by 26 in the figures, which is defined on the inner side of a respective wall 11*b* and 11*c*; and at least one second sliding seat, designated by 27, which is defined in a second wall of the dispenser body 11—here represented by the wall 11*a*—that is generally orthogonal to the walls 11*b* and 11.

In general, in various embodiments, in, or in the proximity of, each wall 11*b* and 11*c*, of the dispenser body 11 a first sliding seat 26 and a second sliding seat 27 are provided, preferably orthogonal to one another.

The first sliding seats 26 are preferably each constituted by a straight and continuous groove or recess (i.e., open at both ends), defined on the inner side of the respective wall 11*b* and 11*c*. The profile of these seats 26 is congruent, in terms of shape and size, to a corresponding portion of the outer profile of the elements 25 so as to guide sliding thereof as precisely as possible.

On the other side, the second sliding seats 27 are basically each constituted by a straight and longitudinally extended recess, slidably engaged in which is a guide part—designated by 28—of the corresponding movable guide element 25. In the case exemplified, given that the guiding recesses 27 are defined in the wall 11*a*, the guide part 28 of the elements 25 projects from a lower face of the elements themselves. The cross section or profile of the part 28 is substantially complementary to that of the respective seat 27, albeit enabling sliding, in order to reduce lateral play. The guide part 28 is here basically configured as a lower relief that extends for a part of the element 25 in the longitudinal direction.

In general, in various embodiments, the guide part 28 extends in a direction substantially orthogonal with respect to the portion of the outer profile of the element 25 that engages the corresponding seat 26.

Preferentially, each guiding recess 27 has two opposite longitudinal ends, which each define a contrast surface or an end-of-travel for the guide part 28 of the corresponding member 25, where the above end-of-travel basically defines the inoperative and operative positions, respectively, of the movable guide element 25. In different embodiments, the opposite longitudinal ends of the recess 27 are open, and the aforesaid end-of-travel and/or inoperative and operative positions can be obtained with other elements, for example, one or more detents defined by the dispenser body.

Figure 12:
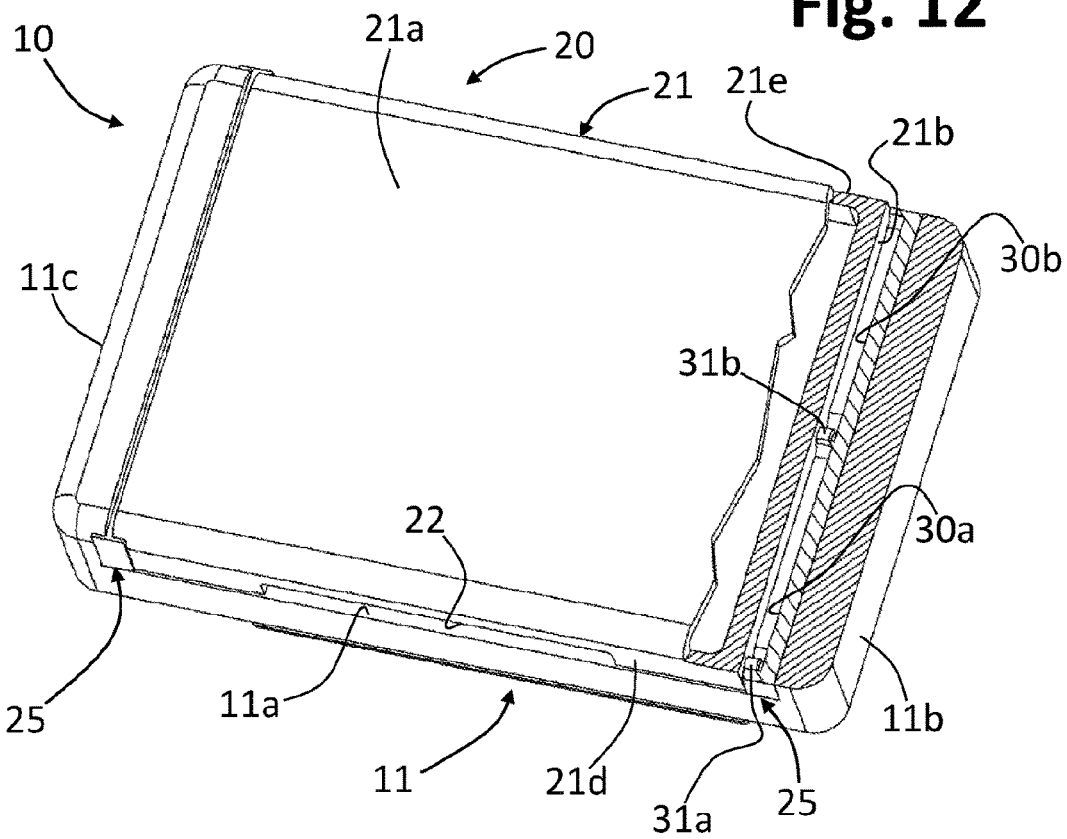
FIGS. 12, 13, and 14 are partially sectioned perspective views, from different angles, of the dispenser of FIGS. 7-8, in conditions of hatch closed, hatch half-open, and hatch open, respectively.

FIGS. 12 and 16, which are partially sectioned for greater clarity, illustrate a condition where the hatch 20 is closed, with the pins 31*a* and 31*b* that engage the initial end regions of the recesses 30*a* and 30*b*, and with the outer side or face of each longitudinal wall 21*b* and 21*c* of the hatch body 21 that completely or prevalently faces the corresponding inner side or face 25*b* of the respective movable guide element 25. The guide arrangement is such that, in the above condition of closing of the hatch 20, each of the movable guide elements 25 is in its inoperative position, i.e., is preferentially located in a substantially retracted or internal position with respect to the dispenser body 11, with its outer side or face 25*a* completely or prevalently facing the corresponding inner side or face of the wall 11*b* or 11*c* of the body 11, within the respective first sliding seats 26. In this condition, the rear end of the guide part 28 of each member 25 substantially comes to bear upon, or be in the proximity of, the initial end of the respective second sliding seat 27 (also in this case the terms "rear" and "initial" are to be understood with reference to the direction of displacement $D_1$ of the hatch 20 from the closing position to the opening position).

Figure 13:
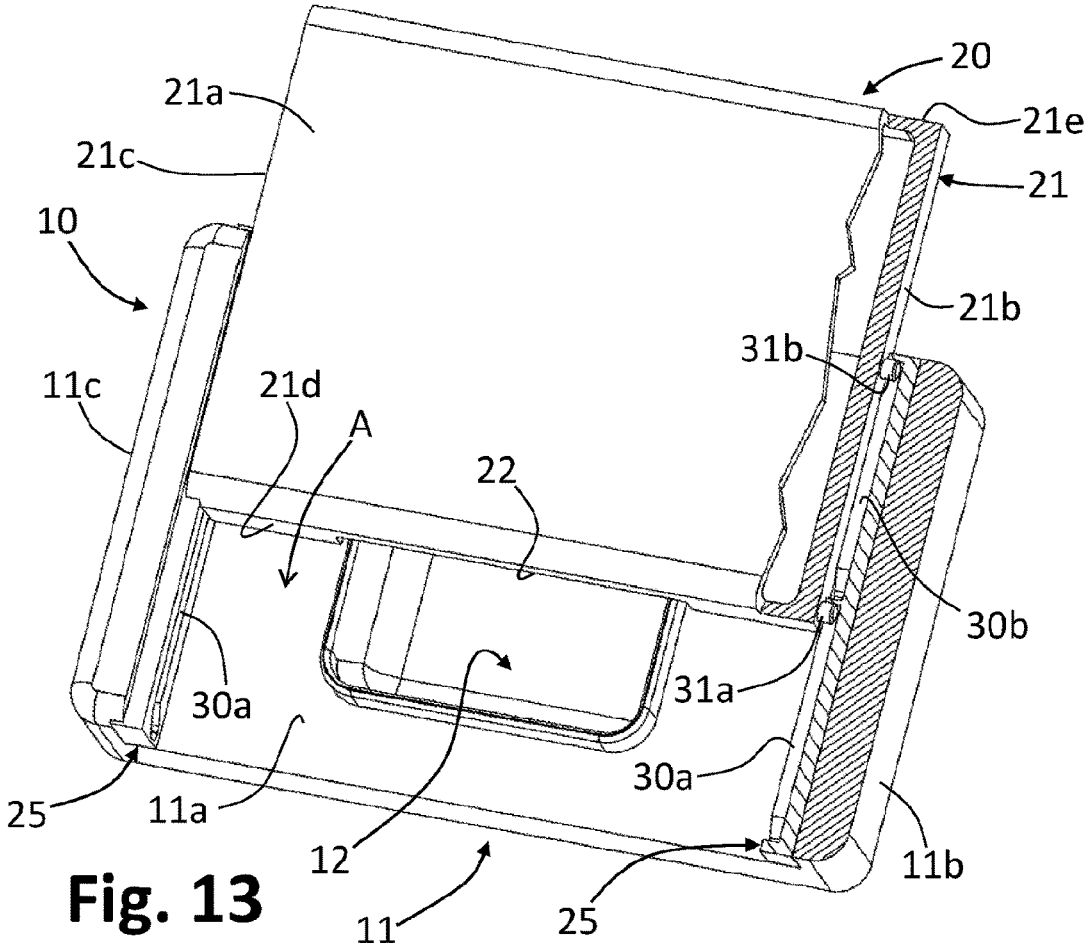
Figure 17:
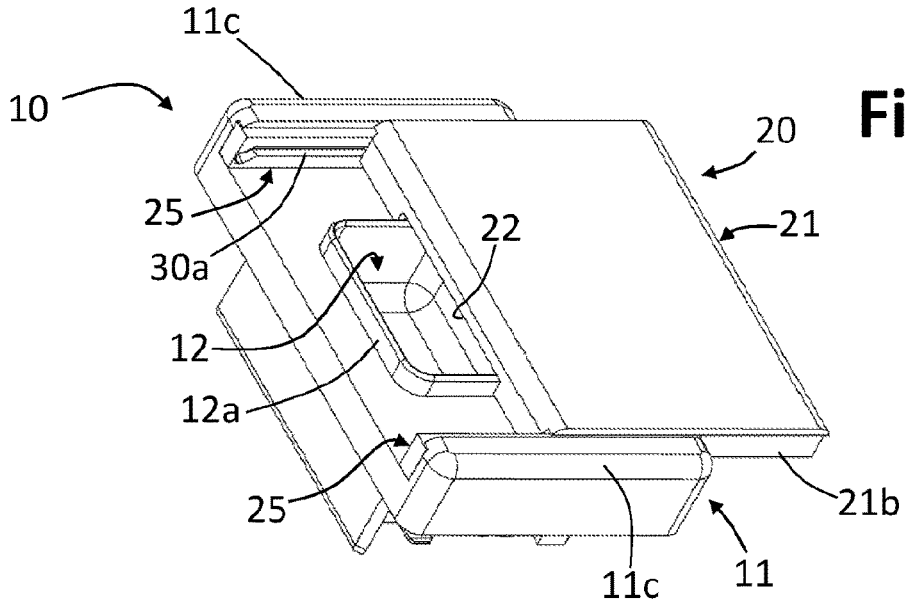

When the hatch 20 is released by the corresponding blocking/release system 14 (FIGS. 8-9)—upon command of the programmer of the dishwasher or manually by the user—the hatch itself is urged by the corresponding spring 13 (see, for example, FIGS. 14-15) towards the opening position, with a sliding of the guided members, represented by the pins 31*a* and 31*b*, along the corresponding guiding members, represented by the recesses 30*a* and 30*b* of the members 25. In the course of this movement, the guided pins 31*a* and 31*b* follow the initial inclined portion of the respective guiding recesses 30*a* and 30*b*, thereby determining a slight raising of the hatch 20 or moving-away thereof with respect to the body 11. The hatch 20 then proceeds with its opening movement, with the guided pins 31*a* and 31*b* that follow the main rectilinear portion of the respective guiding recesses 30*a* and 30*b*, until they come to bear upon the final ends of the recesses themselves. This intermediate condition is represented in FIGS. 13 and 17.

As the opening process continues, the action of the spring 13 on the hatch body 21 is such as to determine sliding of the guide elements 25 towards the outside of the dispenser body 11, in the direction $D_1$. In practice, the hatch body 21—the pins 31*a* and 31*b* of which bear upon the final ends of the respective guiding recesses 30*a* and 30*b*—draws each movable guide element 25 along with it until the final opening position is reached. Hence, in this step, the elements 25 slide within the corresponding first sliding seats 26 defined in the side walls 11*b* and 11*c* of the body 11. At the same time, the guide parts 28 of the elements 25 displace in the respective second sliding seats 27.

This sliding of the elements 25 terminates when the front ends (with reference to the direction $D_1$) of the guide parts 28 of the members 25 come to bear upon the final ends of the respective second sliding seats 27.

Figure 15:
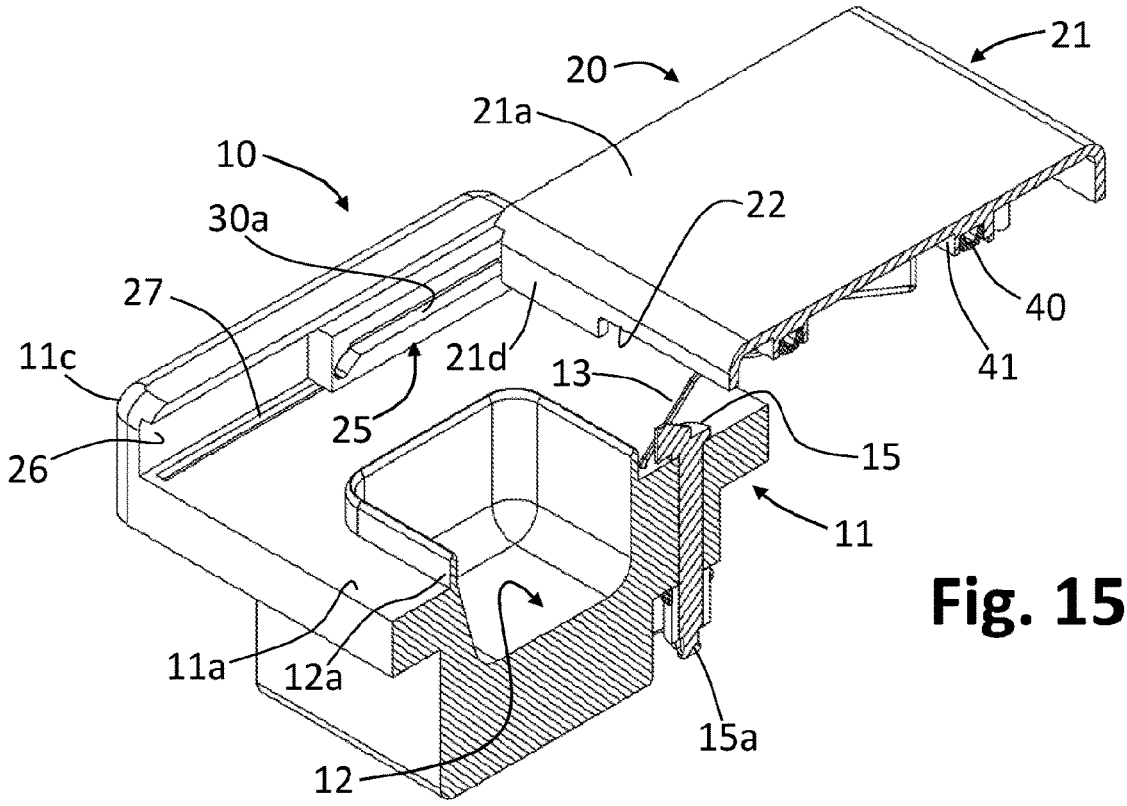
FIG. 15 is a sectioned perspective view of the washing-agent dispenser of FIGS. 7-8, in a condition of hatch open.
Figure 14:
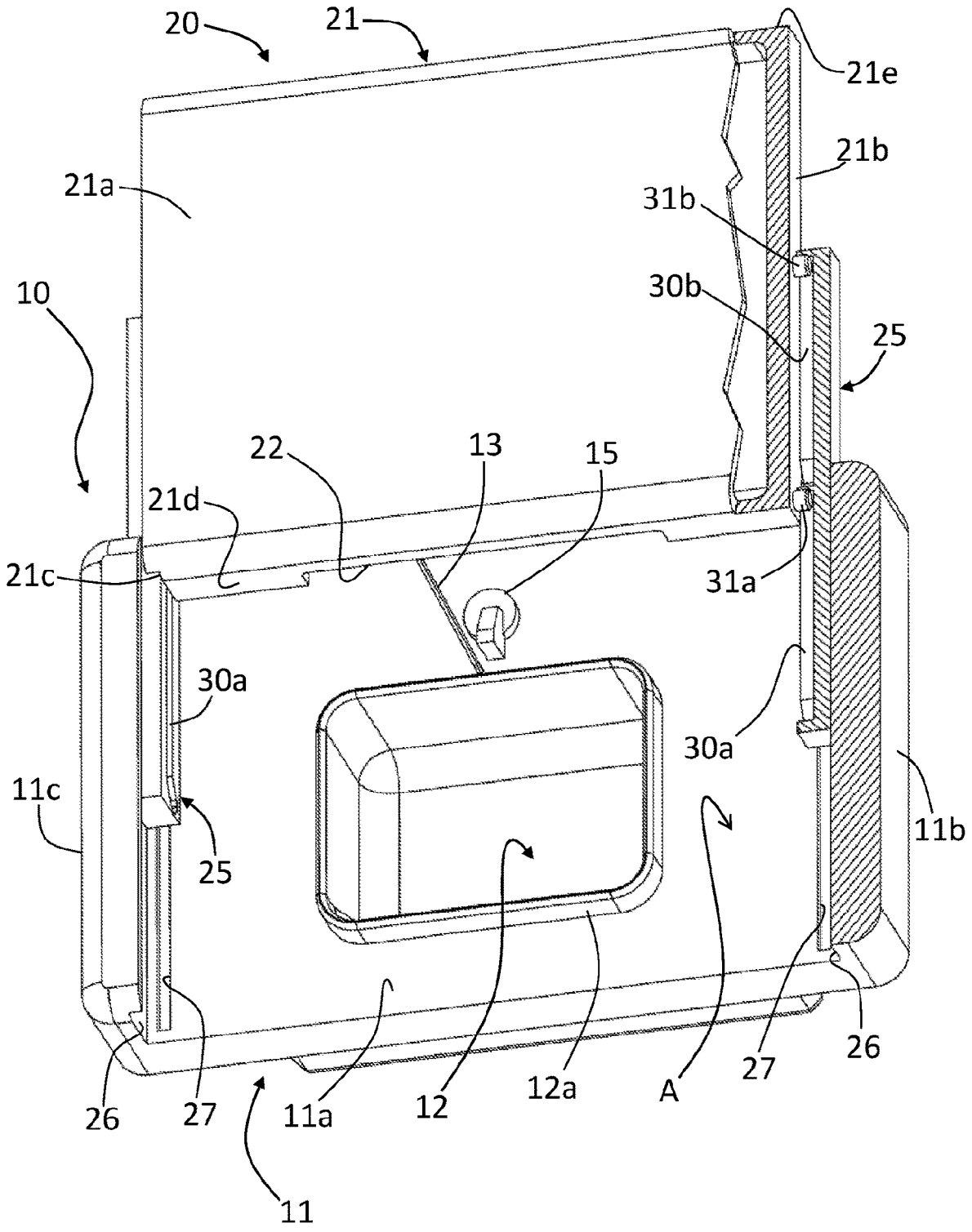

This condition is illustrated in FIGS. 14-15 and 18. As may be noted, in the final position of opening of the hatch 20, the movable guide elements 25 are in a condition where they are at least in part extracted with respect to the dispenser body 11, i.e., with a portion thereof that projects in cantilever fashion relative to the body 11. Preferably, the elements 25 are extracted or project in cantilever fashion from the profile of the body 11 for approximately half of their length, or else for a portion comprised between one third and two thirds of their length. In various embodiments, the elements 25 hence behave substantially as two beams that project in cantilever fashion from the dispenser body for supporting the hatch, in particular, two beams in which the length of their cantilevered portion is variable depending upon the position of the hatch.

With the dispenser 10 according to the invention, it is possible to obtain a travel of opening of the hatch 20 that is decidedly more extensive as compared to the prior art exemplified in FIGS. 1-6. This characteristic can be clearly inferred, for example, from the comparison between FIGS. 4 and 18, the latter representing the end-of-travel position of opening of the hatch 20, i.e., a situation similar to the one represented in FIG. 14. As may be inferred from FIG. 14, the guided pins 31*a* and 31*b* of the hatch body 21 bear upon the final ends of the guiding recesses 30*a* and 30*b* of the members 25, with the latter that have likewise reached the respective mechanical end-of-travel position. In this condition, at least the guided pins 31*b* of the hatch body 21 are located beyond the rear profile (with reference to the direction $D_1$) of the dispenser body 11, whereas the guided pins 31*a* are located in the proximity of the rear profile of the body 11.

Figure 1:
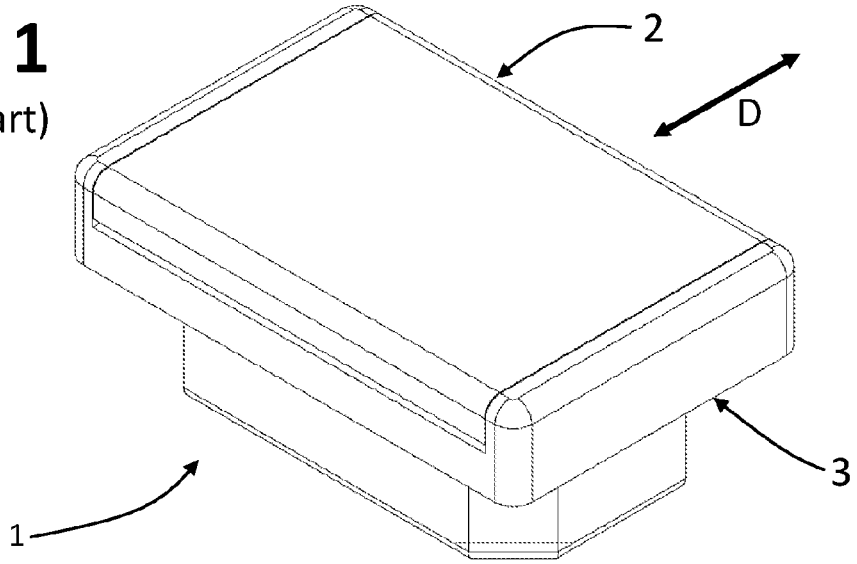
Fig. 1 (prior art)
FIG. 1 is a schematic perspective view of a washing-agent dispenser of a known type.
Figure 2:
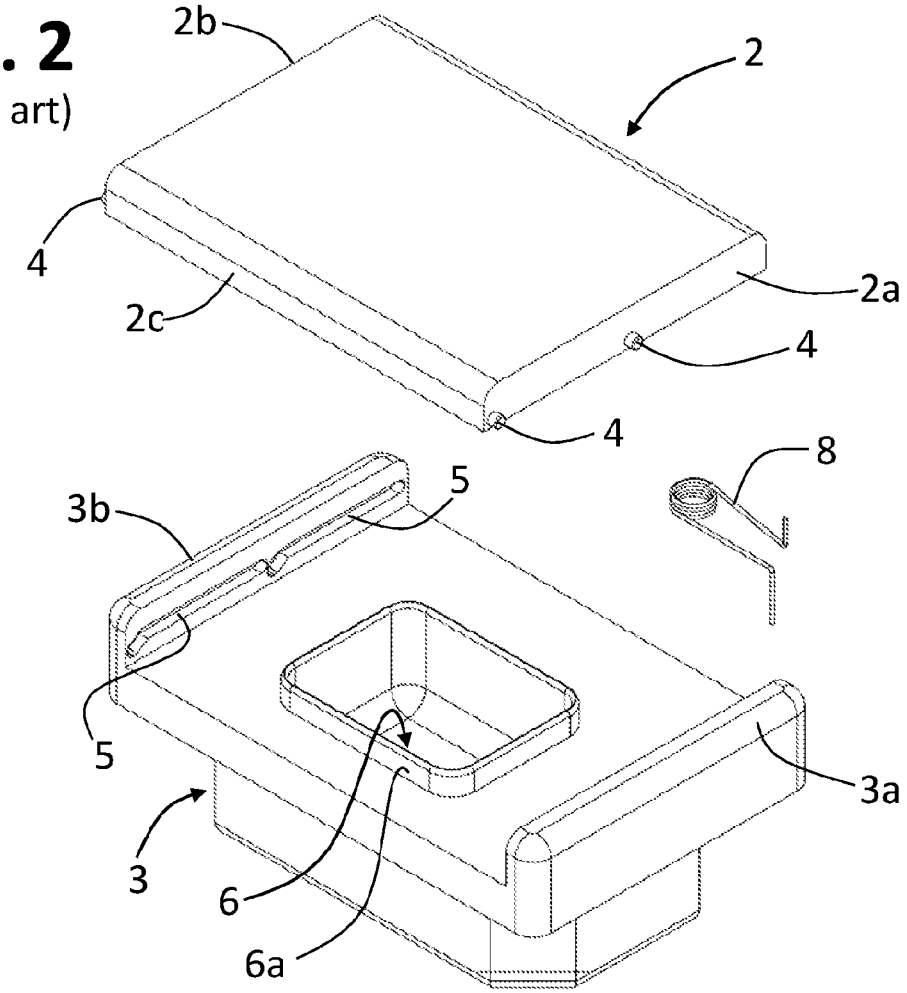
Fig. 2 (prior art)
FIG. 2 is a partially exploded view of the dispenser of FIG. 1.
Figure 3:
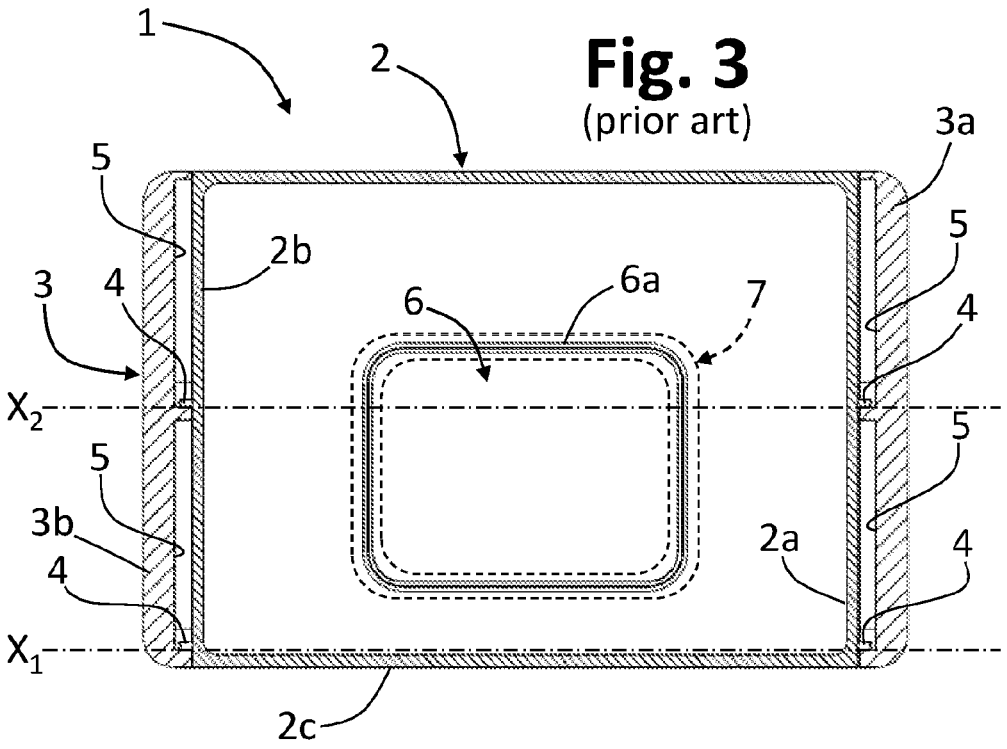
Fig. 3 (prior art)
FIGS. 3 and 4 are partial and schematic longitudinal sectional views of the dispenser of FIG. 1, in a closing position and an opening position of a corresponding hatch, respectively.
Figure 4:
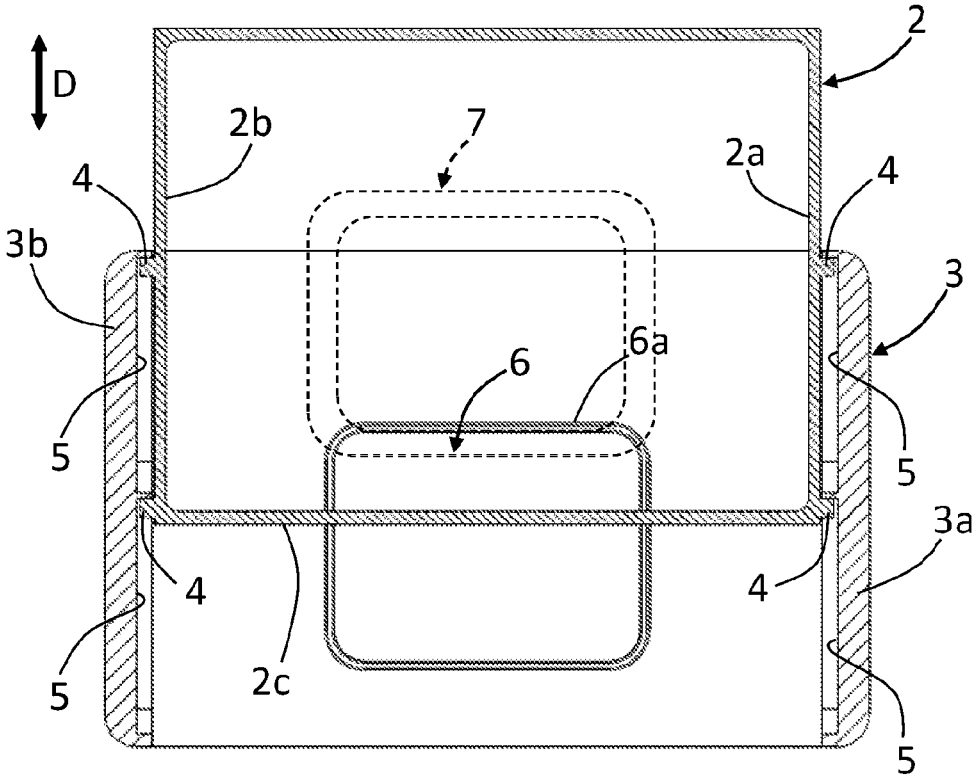
Fig. 4 (prior art)
Figure 5:
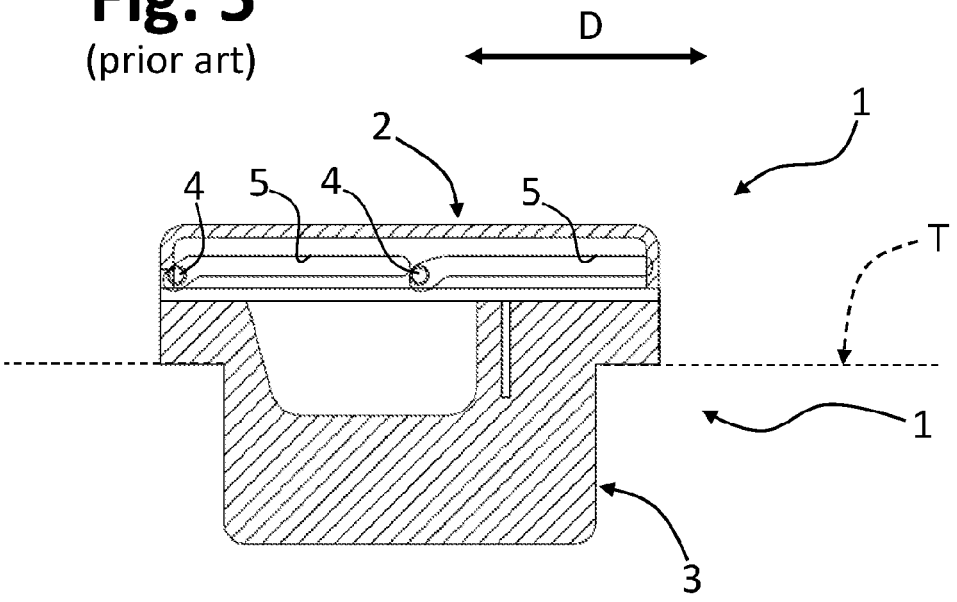
Fig. 5 (prior art)
FIGS. 5 and 6 are partial and schematic cross-sectional views of the dispenser of FIG. 1, in a closing position and an opening position of a corresponding hatch, respectively.
Figure 6:
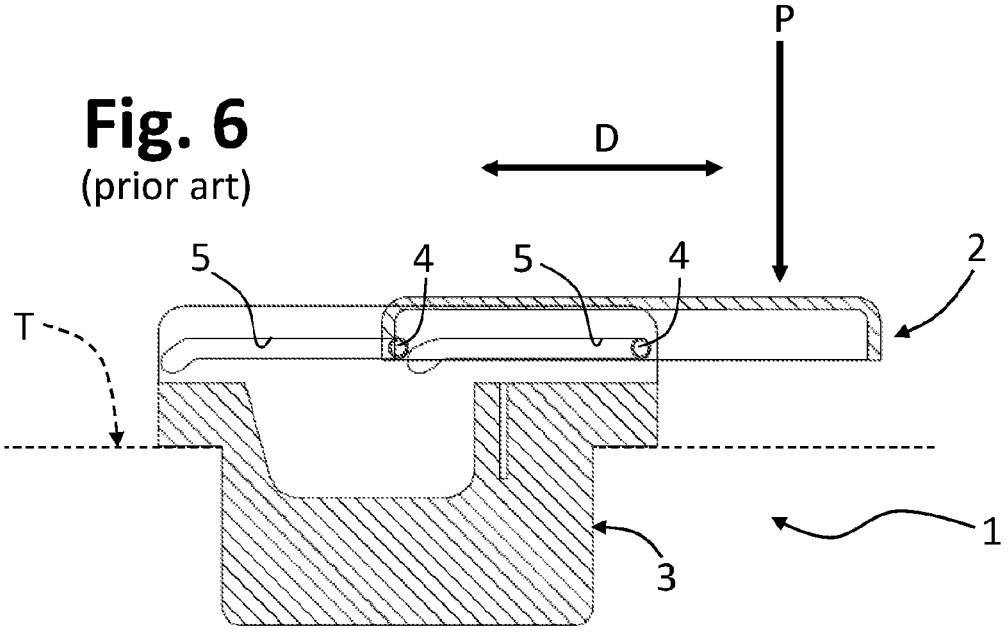
Fig. 6 (prior art)

As may be noted from FIG. 18—and given substantially the same dimensions of the dispenser body, of the hatch body, and of the receptacle, and positioning of the latter with respect to the known dispenser of FIG. 4—in the dispenser 10 according to the invention, the greater travel of opening allowed for the hatch 20 enables the receptacle 12 to be set in a position where it is completely open or exposed to the washing jets, with facilitated delivery and/or removal of the washing agent contained therein, whether this is a powder mass, a tablet, a liquid, a gel, or a foam, moreover enabling a better washing and cleaning of the receptacle by the washing jets. Obviously, also loading of the washing agent into the receptacle 12 is facilitated, when the hatch 20 is open.

When it is necessary to re-close the hatch 20, the user simply has to push the hatch body 21 in an opposite direction to that of opening, countering the action of the spring 13. In this way, the guided pins 31*a* and 31*b* are brought to slide in the corresponding guiding recesses 30*a* and 30*b*, from the respective final ends to the respective initial ends. After the pins 31*a* and 31*b* have come to bear upon the initial ends of the recesses 30*a* and 30*b*, continuation of the thrust exerted by the user also brings about sliding of the elements 25, which displace from their operative position to their inoperative position, within the respective slide guides 26, until engagement in closing of the hatch body 21 is again obtained, via the blocking/release system 14 (FIGS. 8-9): in this condition, the front end of the guide part 28 of each member 25 substantially bears upon, or is in the proximity of, the initial end of the corresponding second slide guides 27.

In particularly advantageous embodiments, the hatch body 21 has an end portion or wall, the lower profile of which defines a recess, so that the aforesaid wall will not interfere with the sealing lip 12*a* of the receptacle 12 during the displacements of the hatch 20 (this portion or wall can here be defined as "rear", with reference to the direction of sliding or displacement $D_1$ of the hatch 20 from the closing position to the opening position). This characteristic enables reduction of the degree of the displacements upwards and downwards of the hatch 20 in the course of its passage between the opening and closing positions, i.e., reduction of the length of the initial inclined portions of the recesses 30*a* and 30*b* and hence, in the ultimate analysis, reduction of the height both of the side walls 11*b*, 11*c* of the body 11 and of the side walls 21*b* and 21*c* of the body 21, to the advantage of compactness of the dispenser 10.

The rear transverse wall of the hatch body 21 is designated by 21d in the figures and is in particular the transverse wall closest to the guided pins 31*a*, i.e., the wall that substantially extends between the side walls 21*b* and 21*c* and is preferably substantially orthogonal to the wall 21*a*, to which the gasket 40 is associated. In the figures, the aforesaid recess is, instead, designated by 22 and is substantially in a central position of the lower profile of the wall 21*d* or, in any case, in a position aligned to the lip 12*a* of the receptacle 12. The recess 22 could also extend substantially throughout the width of the wall 21*d*. In the figures, the reference 21*e* designates the front wall of the hatch body 21.

The dimensions in height and width of the recess 22 are such that, in the movement of the hatch 20, its transverse wall 21*d* will not interfere with the lip 12. The concept may clearly be inferred from FIGS. 17 and 18, where the hatch 20 is represented in an intermediate position and in the final position, respectively, of its opening movement.

As has been mentioned, in the operative position of the elements 25, corresponding to which is the position of opening of the hatch 20, a portion of the guide elements 25 projects in cantilever fashion relative to the dispenser body 11 (see, for example, FIGS. 14 and 18). This projecting portion of the elements 25 hence forms a support for the hatch body 21, at its two opposite longitudinal sides. In such a condition, the presence of the aforesaid projecting portions of the elements 25 makes it possible to counter any possible bending or stress that can be exerted from above on the hatch 20, due, for example, to incorrect forcing exerted by the user during closing of the hatch 20. The "slidable-rail" structure, constituted by each element 25 slidable in the corresponding seat 26, affords good guiding stability and high resistance to stresses exerted by the user.

FIGS. 19-27 illustrate a dispenser 10 according to further possible embodiments of the invention, distinguished by a different configuration of the guide arrangement of the hatch 20, in any case once again comprising movable guide elements 25 constrained to linear sliding.

Figure 20:
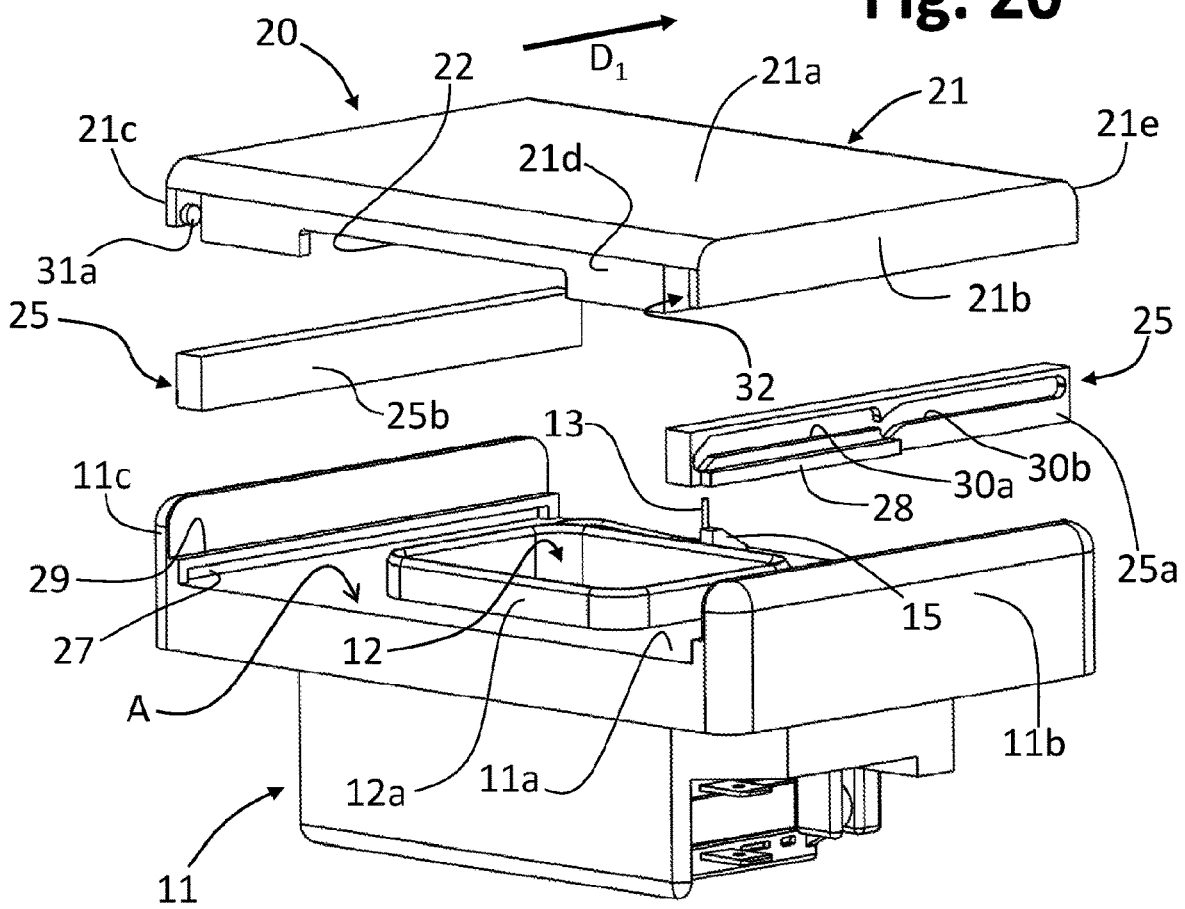
FIGS. 20 and 21 are partially exploded views, from different angles, of the dispenser of FIG. 19.
Figure 21:
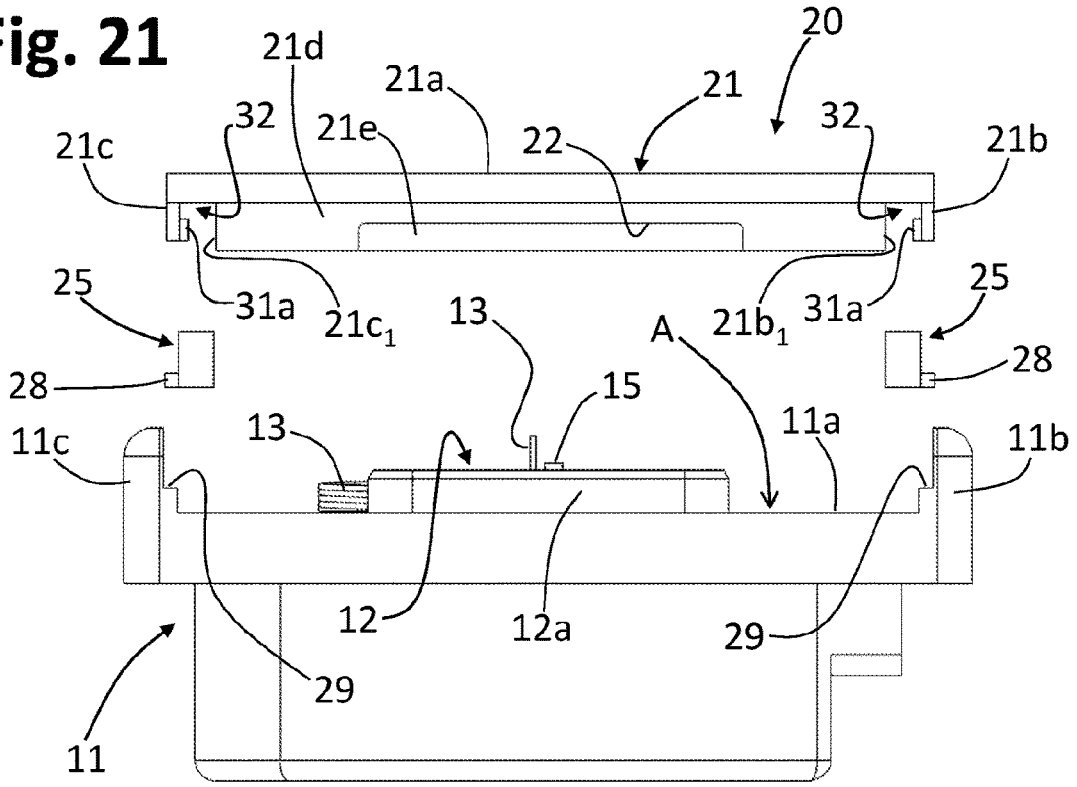

In these embodiments, and as emerges in particular from FIGS. 20 and 21, the guiding recesses 30*a* and 30*b* are on the outer side or face 25*a* of the respective element 25, whereas the guided pins 31*a* and 31*b* are on the inner side or face of the walls 25*b* and 25*c* of the hatch body 21. In embodiments of this type, it is moreover preferable to provide in the front wall 21*e* and in the rear wall 21*d*, when envisaged by the hatch body 21, a slit in the proximity of the intersection with the side walls 21*b* and 21*c*, in order to enable correct housing and/or sliding of the elements 25: some of these slits are designated by 32 (between the wall 21*d* and the wall 21*b*) in FIGS. 20-21, and by 33 (between the wall 21e and the wall 21*b*) in FIGS. 23-24.

For the same reason, it is also preferable for the hatch body 21 to define respective walls generally parallel to the walls 21*b* and 21*c*, at a distance therefrom. These walls are designated by 21$b_1$ and 21$c_1$ in FIG. 21, the wall 21$d_1$ being visible also in FIGS. 22-24. In this way, each element 25 is slidably positioned between the walls 21*b* and 21$b_1$, on one side, and the walls 21*c* and 21$c_1$ on the other, with the inner face 25*b* of each element 25 that faces and can slide also along the respective wall 21$b_1$ and 21$c_1$. These walls 21$b_1$ and 21$c_1$ contribute to keeping in position the elements 25 against the pins 31*a* and 31*b* of the hatch body and in the corresponding slide guides 27 of the dispenser body 11. The elements 25 can be mounted relative to the hatch body 21 and to the pins 31*a* thanks to the slight elasticity allowed by the plastic material of which the body 21 is made.

In embodiments not represented, the walls 21$b_1$ and 21$c_1$ are replaced by similar walls defined by the dispenser body 11, in positions that are substantially the same as the ones represented for the aforesaid walls 21$b_1$ and 21$c_1$.

FIGS. 19-27 also illustrate embodiments distinguished by a different conformation of the sliding seats 27 for the members 25, as well as of the corresponding guide parts 28 of the elements 25. In particular, in the case of FIGS. 19-27, the sliding seats 27 are defined on the inner side of the side walls 11*b* and 11*c* of the dispenser body 11, in the form of longitudinally extended recesses, with the respective guide parts 28 that project laterally from the elements 25, in particular on their outer side or face, as may be noted in particular from FIGS. 19-20. In the case illustrated, the seats 27 are defined in a base portion 29 that projects from the inner side of the walls 11*b* and 11*c*.

In the assembled condition of the dispenser 10, the guide parts 28 are inserted in the respective guides 27, with the lower portion of the outer side or face 25*a* of the elements 25 that laterally faces the base portion 29, substantially in contact therewith, whereas the upper portion of the same side or face 25*a* laterally faces the upper portion of the corresponding wall 11*b* and 11*c*, but at a distance therefrom. In this way, above the base portion 29, between the wall 11*b* or 11*c* and the corresponding element 25 a gap is delimited, into which a corresponding longitudinal wall 21*b* or 21*c* of the hatch body 21 can penetrate: this characteristic may be inferred, for example, from FIG. 19.

Figure 22:
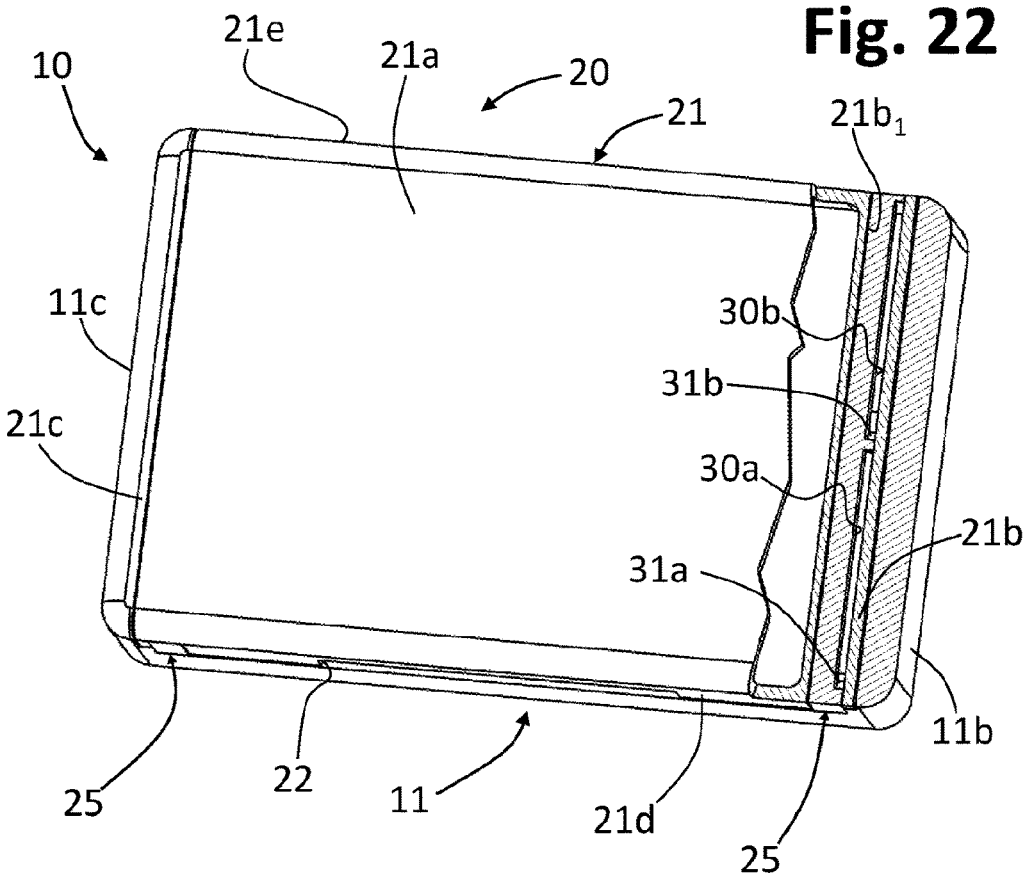
FIGS. 22, 23, and 24 are partially sectioned perspective views, from different angles, of the dispenser of FIG. 19, in conditions of hatch closed, hatch half-open, and hatch open, respectively.
Figure 23:
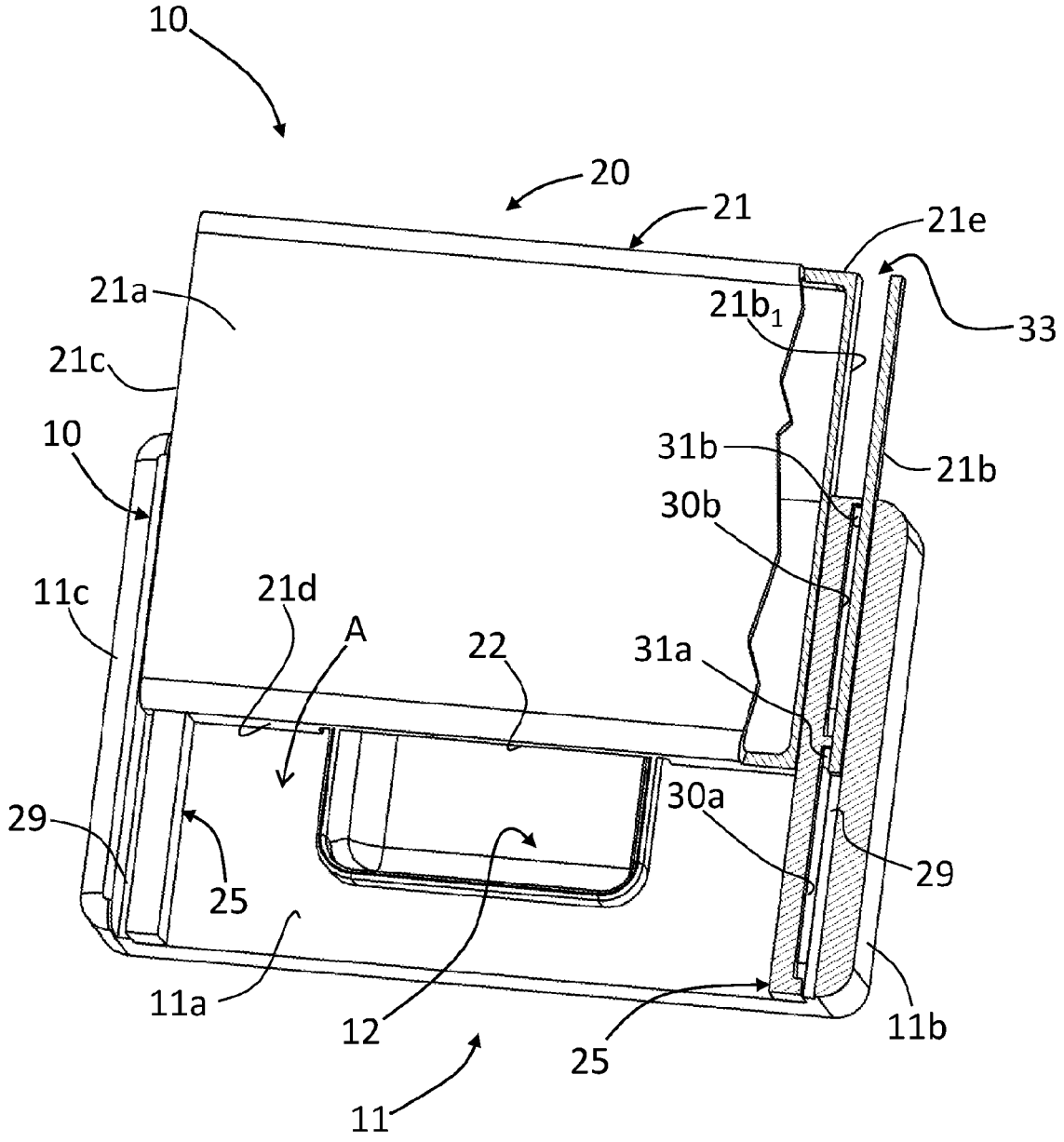
Figure 24:
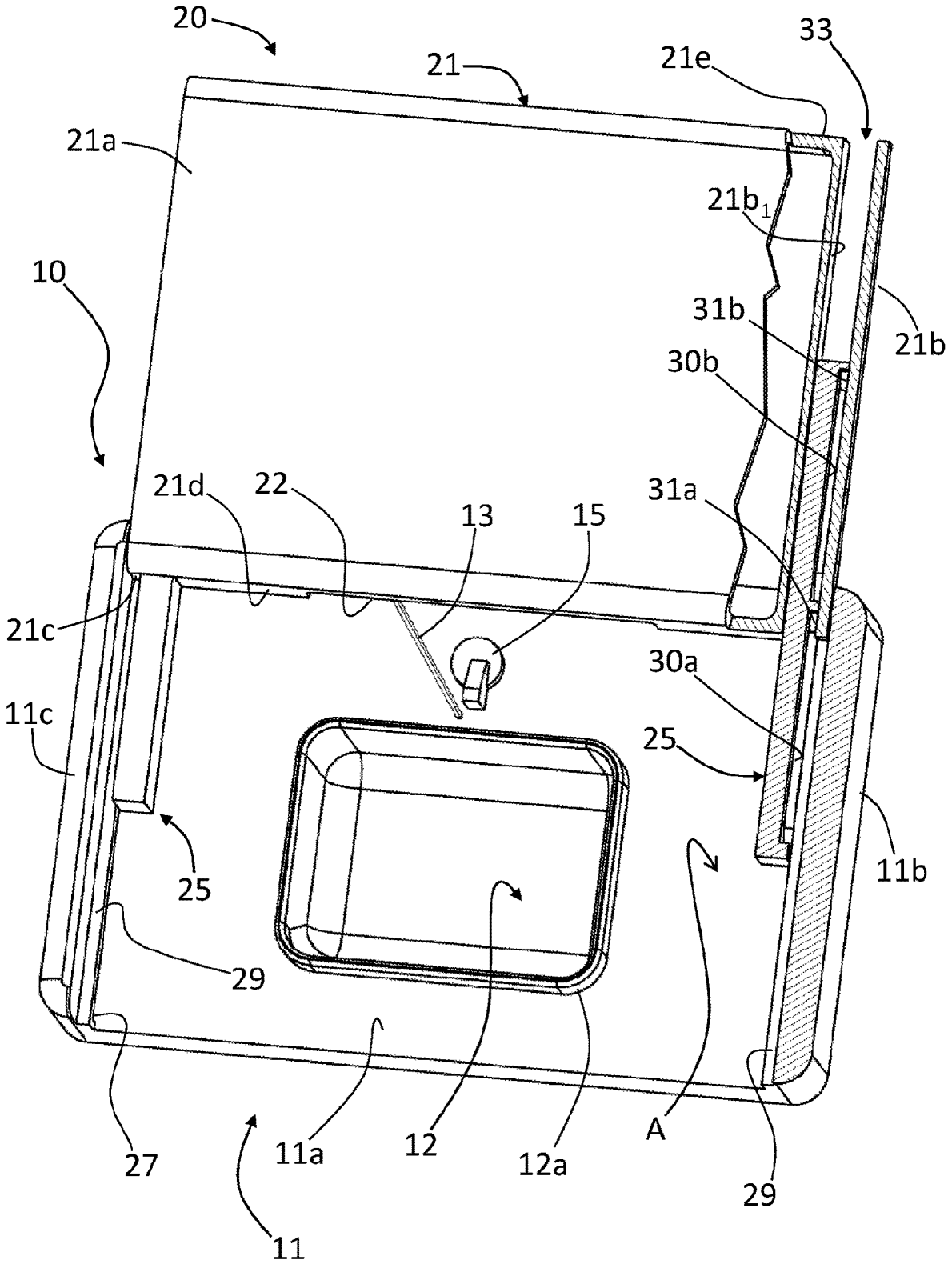
Figure 25:
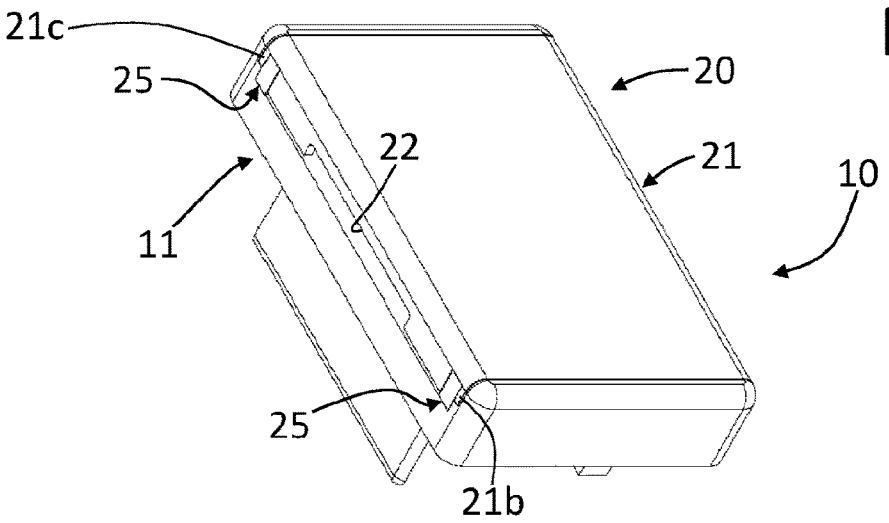
FIGS. 25, 26, and 27 are schematic perspective views of the washing-agent dispenser of FIG. 19, in conditions of hatch closed, hatch half-open, and hatch open, respectively.
Figure 26:
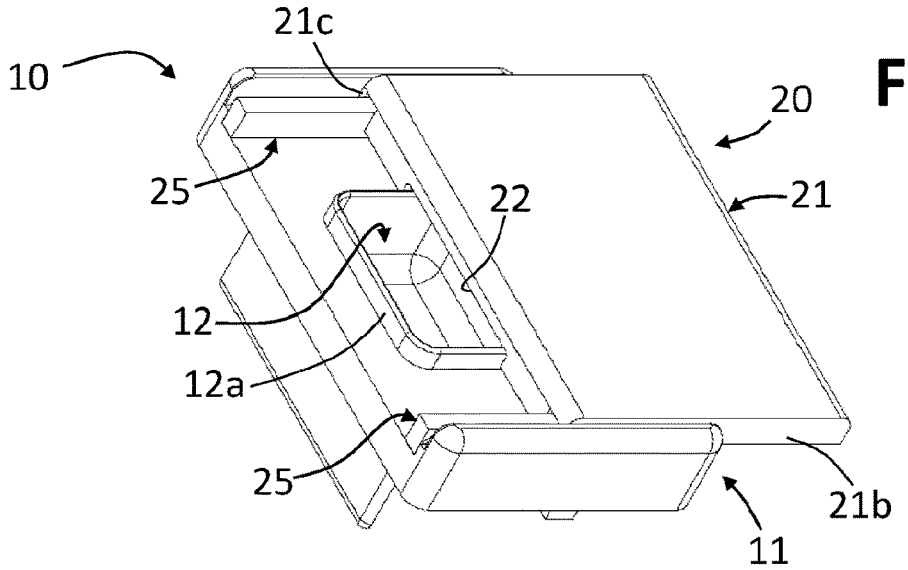
Figure 27:
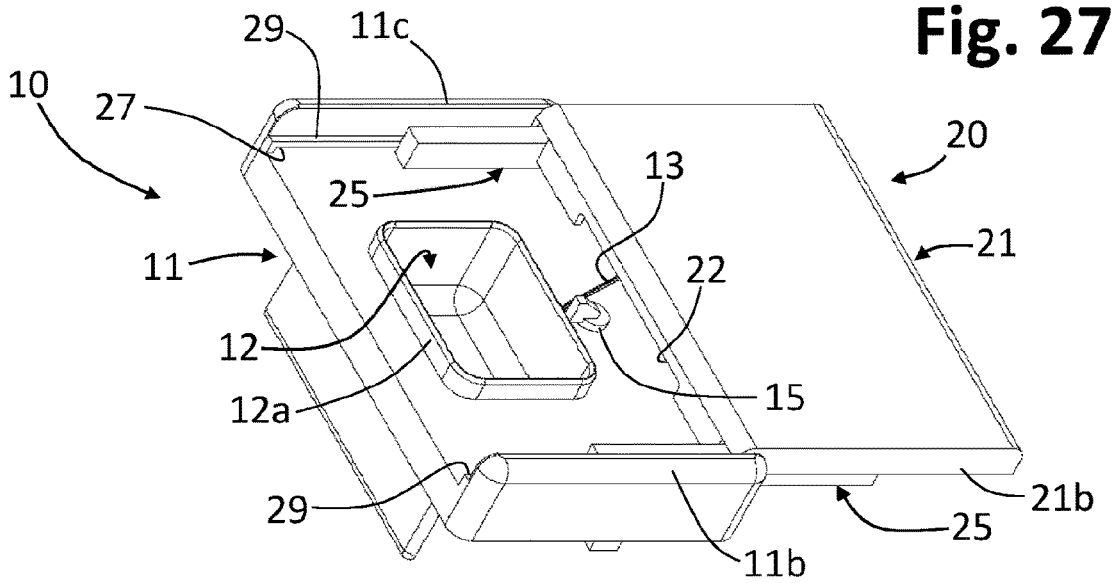

As may be appreciated, operation of the dispenser 10 of FIGS. 19-27, in relation to the movement of the hatch body 21, is similar to what has been described previously with reference to FIGS. 1-18. FIGS. 22 and 25 illustrate the condition of hatch 20 closed, FIGS. 23 and 26 illustrate an intermediate condition of opening of the hatch 20, and FIGS. 24 and 27 illustrate the condition of complete opening of the hatch 20. As has been said, the walls 21$b_1$ and 21$c_1$ can be replaced by similar walls defined by the dispenser body 11 in positions that are substantially the same as the ones represented for the aforesaid walls 21$b_1$ and 21$b_1$.

From the foregoing description, the characteristics of the present invention emerge clearly, as likewise its advantages. The dispenser forming the subject of the invention enables an increased travel of opening of the corresponding slidable hatch to be obtained, in any case guaranteeing the necessary precision of movement thereof thanks to the presence of the movable guide elements, in particular of a slidable type. The fact that, in the opening condition, these elements project in cantilever fashion from the dispenser body in order to perform thereby a function of support to the hatch, enables an increase in the stability and protection of the hatch itself against undesirable stresses.

It is clear that numerous variations may be made by the person skilled in the branch to the dispenser described by way of example, without thereby departing from the scope of the invention as defined in the ensuing claims.

As already mentioned, according to possible embodiments not represented, some of the guiding members (for example, two recesses 30*a* and 30*b*) and the corresponding guided members (for example, two pins 31*a* and 31*b*) could be provided between the inner side or face of the wall 21*b* and the outer side or face 25*a* of a movable guide element 25 (as in the embodiments of FIGS. 19-27), whereas the guiding members and the opposite guided members (for example, the other two recesses 30*a* and 30*b* and the other two pins 31 and 31*b*) could be provided between the outer side or face of the wall 21*c* and the inner side or face 25*b* of the other movable guide element 25 (as in the embodiments of FIGS. 1-18).

Figure 28:
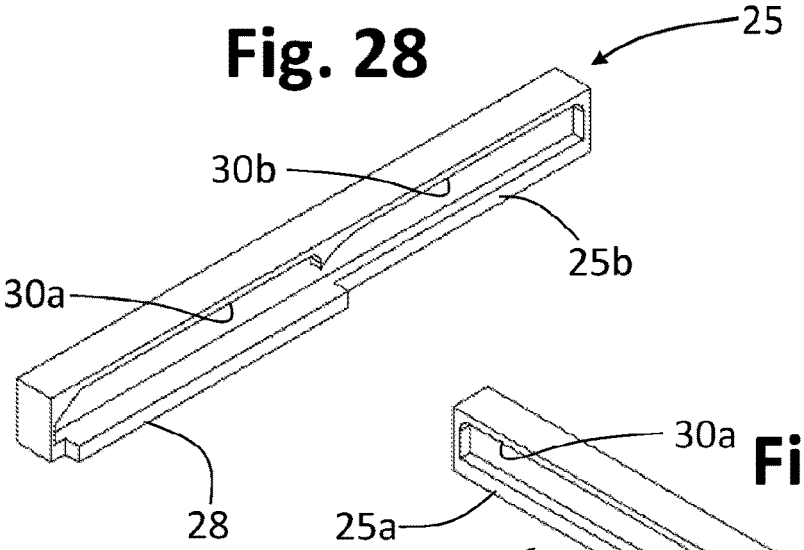
FIGS. 28-29 are schematic perspective views, from different angles, of a guide component of a washing-agent dispenser according to further possible embodiments of the invention.
Figure 29:
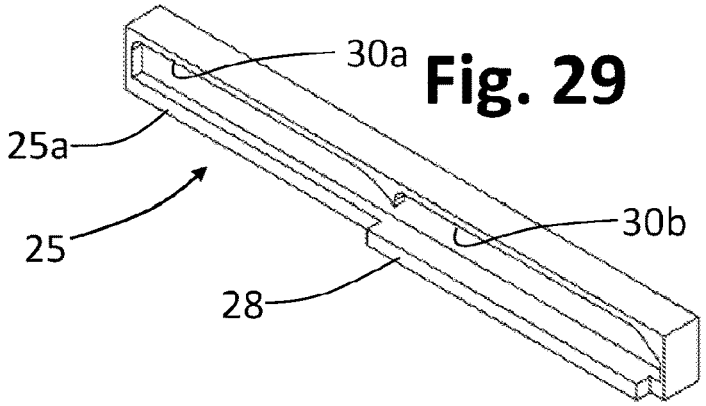
Figure 30:
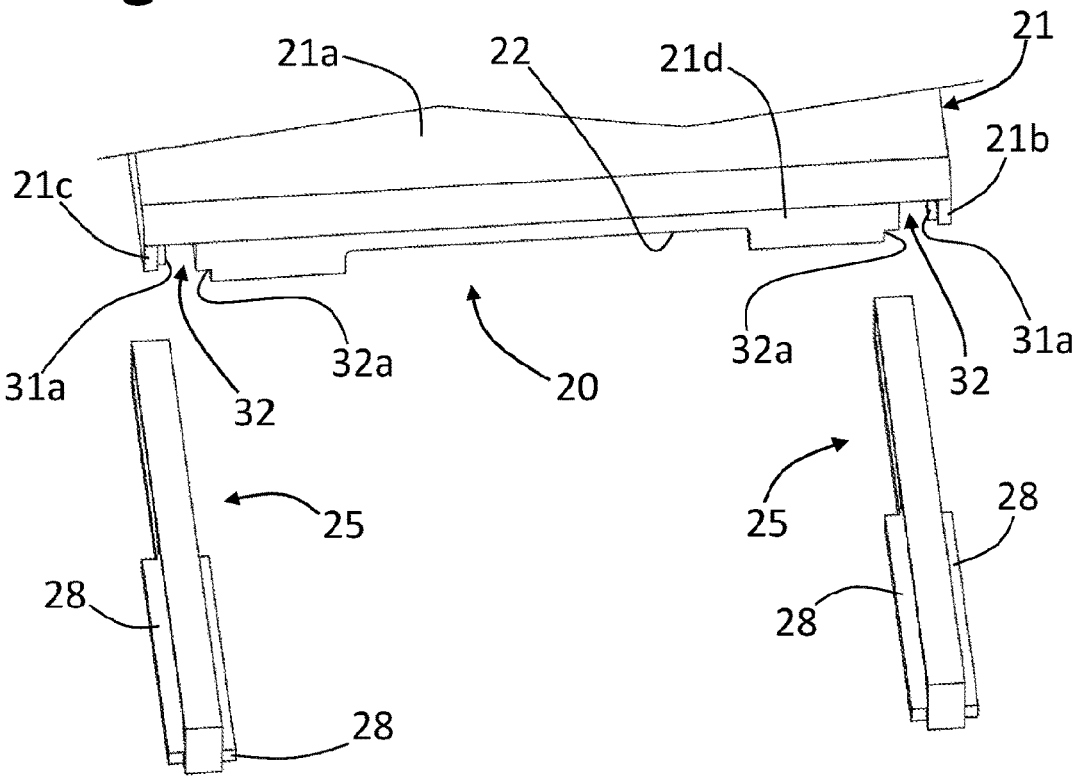
FIG. 30 is a schematic perspective view of a part of a dispenser that uses a pair of guide components according to FIGS. 28-29.

In the embodiments exemplified previously, the two movable guide elements 25 have a substantially specular shape, i.e., they have a shape different from one another that depends upon their positioning at the right-hand side and left-hand side of the dispenser body 11, respectively. According to possible variant embodiments, however, it is possible to provide a single version of movable guide elements 25, that can be used indifferently on the right-hand side or on the left-hand side, to the advantage of standardisation of production. Such a case is exemplified in FIGS. 28 and 29, where one and the same guide element 25 has, at both of its faces 25*a* and 25*b*, both guiding recesses 30*a*, 30*b* and a guide part 28. As may be appreciated, guide elements 25 of this type can be indifferently mounted on the right-hand side or on the left-hand side of the dispenser body 11 of FIGS. 19-27. In these applications, it is preferable for the slits 32 of the rear wall 21*d* of the hatch body 21 (when this wall is envisaged) and/or the walls $\mathbf{21}b_1$ and $\mathbf{21}c_1$ (when these walls are envisaged) to be shaped so as to enable housing/sliding of the guide part 28 of the element 25 that is not active, i.e., is not engaged in the corresponding sliding seat 27. Such a case is exemplified in FIG. 30, where designated by 32*a* is a step of the slit 32 (and/or of the wall $\mathbf{21}b_1$, $\mathbf{21}c_1$) that enables passage of said non-active guide part 28.

Obviously, also the guide elements 25 of FIGS. 1-27 can be modified so as to have respective guiding recesses 30*a* and 30*b* on both of their faces 25*a* and 25, for purposes of standardisation of production.

As already mentioned, the shape of the guiding recesses of the elements 25 can be chosen according to the desired type of sliding for the hatch 20: examples in this sense are provided in FIGS. 31-32 and 33-34.

FIGS. 31-32 illustrate the case where the guiding recesses 30*a* and 30*b* have a path of a winding type, i.e., with curves or inclination in different directions, in particular an S-shaped path, so as to obtain a corresponding movement of the hatch 20 in the course of its displacements between the opening and closing positions. The aforesaid path is represented by a series of linear stretches, it being possible, however, for it to be formed by a series of curved stretches or a combination of linear and curved stretches. In the case of FIGS. 33-34, the recesses 30*a* and 30*b* have the initial inclined portions already described that extend downwards, whereas the main remaining part of each recess 30*a* and 30*b* is generally arched, instead of being rectilinear as in the case of FIGS. 1-18. FIGS. 31-34 illustrate elements 25 of the type described with reference to FIGS. 1-18, but obviously the same concepts may apply also to the elements 25 of FIGS. 19-27 and 28-30.

It should moreover be noted that the two guiding recesses 30*a* and 30*b* could be obtained via an appropriately shaped single groove: such a case is exemplified in FIGS. 19-29.

The invention claimed is:

1. A washing-agent dispenser for dishwashers, comprising:

a dispenser body with at least one receptacle for containing a washing agent;

at least one hatch having a hatch body mounted in a guided way with respect to the dispenser body for being slidable between a position of closing and a position of opening of the at least one receptacle, the hatch body having two longitudinal walls or sides generally parallel to one another and with respect to a direction of displacement of the hatch body between the position of opening and the position of closing;

a guide arrangement between the dispenser body and the hatch body, for guiding displacement of the hatch body between the position of opening and the position of closing, wherein:

the guide arrangement comprises at least one movable guide element in a position corresponding to a respective longitudinal wall or side of the hatch body, the at least one movable guide element being constrained to the dispenser body for being slidable between an inoperative position and an operative position;

the hatch body is in turn constrained to the at least one movable guide element for being slidable between a respective inoperative position and a respective operative position, the latter corresponding to said position of opening of the hatch body, in such a way that, in its operative position, the at least one movable guide element is in a condition where it is at least in part extracted or cantilevered with respect to the dispenser body.

2. The dispenser according to claim 1, wherein the at least one movable guide element comprises at least two movable guide elements, each in a position corresponding to a respective longitudinal wall or side of the hatch body, the two movable guide elements being constrained to the dispenser body to be each slidable between the respective inoperative position and the respective operative position, and wherein the hatch body is in turn constrained to the movable guide elements for being slidable between the respective inoperative position and the respective operative position.

3. The dispenser according to claim 1, wherein the guide arrangement comprises guiding members and guided members.

4. The dispenser according to claim 3, wherein the guiding members comprise at least one seat, on a first longitudinal face of the at least one movable guide element, or of each movable guide element, and the guided members comprise at least one projecting element, on a first longitudinal face of the hatch body that faces the first longitudinal face of a corresponding movable guide element, the at least one projecting element being slidably engaged in the at least one seat.

5. The dispenser according to claim 4, wherein:

the first longitudinal face of the at least one movable guide element, or of each movable guide element, is an inner face of the movable guide element, and the first longitudinal face of the hatch body is an outer face of the hatch body; or else the first longitudinal face of the at least one movable guide element, or of each movable guide element, is an outer face of the movable guide element, and the first longitudinal face of the hatch body is an inner face of the hatch body.

6. The dispenser according to claim 4, wherein the at least one seat comprises a first seat and a second seat, and the at least one first projecting element comprises a first projecting element and a second projecting element, the first and second projecting elements being engaged in the first and second seats, respectively.

7. The dispenser according to claim 1, wherein the guide arrangement comprises at least one sliding seat for the at least one movable guide element, or for each movable guide element, which is defined in the dispenser body.

8. The dispenser according to claim 7, wherein:

the dispenser body has two first opposite walls that are generally parallel to one another and with respect to the direction of displacement of the hatch body between the position of opening and the position of closing; and the at least one sliding seat is defined substantially at, or in the proximity of, a respective one of said first opposite walls or else is defined in at least one of said first opposite walls of the dispenser body.

9. The dispenser according to claim 8, wherein at least one sliding seat is defined in a second wall of the dispenser body generally orthogonal to said two first opposite walls.

10. The dispenser according to claim 7, wherein the at least one sliding seat comprises a guide recess in which is slidably engaged a guide part of the at least one movable guide element, or of each movable guide element.

11. The dispenser according to claim 10, wherein the guide part projects from a lower face or else from an outer or longitudinal face of the at least one movable guide element, or of each movable guide element.

12. The dispenser according to claim 1, wherein the hatch body has at least one end wall the lower profile of which defines at least one of:

a recess configured in such a way that the aforesaid end wall does not interfere with a projecting edge of the at least one receptacle during displacement of the hatch body between the position of opening and the position of closing;

a slit, designed to enable housing and/or sliding of a respective movable guide element.

13. The dispenser according to claim 1, wherein at least one of the hatch body and the dispenser body has at least one further wall parallel to a respective one of said longitudinal walls or sides of the hatch body, and said at least one movable guide element is slidably positioned between the further wall and said respective one of said longitudinal walls or sides of the hatch body.

14. A household dishwasher, comprising the washing-agent dispenser according to claim 1.

15. The dispenser according to claim 3, wherein the guiding members belong to the at least one movable guide element, or to each movable guide element, and the guided members belong to the hatch body.

16. The dispenser according to claim 4, wherein the at least one seat is in the form of a longitudinally extended recess, and the at least one projecting element is in the form of pin or stud.

17. The dispenser according to claim 9, wherein the at least one receptacle opens at said second wall.

18. The dispenser according to claim 10, wherein the guide recess has two opposite ends, at least one of which defines an end-of-travel for the guide part, which corresponds to at least one of the inoperative position and the operative position of the corresponding movable guide element.

19. The dispenser according to claim 12, wherein said slit is set substantially in the proximity of an intersection between said end wall and one of said longitudinal walls or sides of the hatch body.

20. The dispenser according to claim 12, wherein said end wall is a rear wall of the hatch body, with reference to the direction of movement of the hatch from the position of closing to the position of opening.

* * * * *